US011518586B2

(12) United States Patent
Tan

(10) Patent No.: US 11,518,586 B2
(45) Date of Patent: Dec. 6, 2022

(54) TAMPER EVIDENT ENCLOSURE FOR A FOOD/BEVERAGE CONTAINER AND METHOD

(71) Applicant: Pan Pacific Plastics Mfg., Inc., Hayward, CA (US)

(72) Inventor: Hin Siang Michael Tan, Danville, CA (US)

(73) Assignee: Pan Pacific Plastics Mfg., Inc., Hayward, CA (US)

( * ) Notice: Subject to any disclaimer, the term of this patent is extended or adjusted under 35 U.S.C. 154(b) by 134 days.

(21) Appl. No.: 16/865,090

(22) Filed: May 1, 2020

(65) Prior Publication Data

US 2020/0354123 A1 Nov. 12, 2020

Related U.S. Application Data

(60) Provisional application No. 62/845,705, filed on May 9, 2019.

(51) Int. Cl.
*B65D 51/02* (2006.01)
*B65D 5/46* (2006.01)
(Continued)

(52) U.S. Cl.
CPC ..... *B65D 51/02* (2013.01); *B65D 5/46104* (2013.01); *B65D 25/22* (2013.01);
(Continued)

(58) Field of Classification Search
CPC ..... B65D 1/02; B65D 5/46104; B65D 25/22; B65D 39/005; B65D 2401/05;
(Continued)

(56) References Cited

U.S. PATENT DOCUMENTS 1,987,063 A * 1/1935 Hinton ..... B65D 5/46104 229/117.15
5,031,824 A * 7/1991 Itey ..... B65D 5/2057 229/110

(Continued)

*Primary Examiner* — J. Gregory Pickett
*Assistant Examiner* — Niki M Eloshway
(74) *Attorney, Agent, or Firm* — Beyer Law Group LLP

(57) ABSTRACT

A tamper evident delivery enclosure assembly that includes a thin base portion having a seating aperture configured to supportably seat a beverage container. A pair of foldable wing extensions coupled to generally opposed sections of the base portion that foldably extend upwardly in a manner such that the foldable wing extensions substantially extend over the container mouth portion and mounted lid to form an interior pocket, in an engaged condition that substantially prevents access to the lid. A single use closure tape, laterally mounted to the wing extensions, has an upper lateral portion extending beyond the wing member, in an unsealed condition. A removable protective strip removably covers the tape adhesive of the tape lateral portion. When the protective strip is removed, and the wing extensions are in the engaged condition, the tape upper lateral portion can be folded over such that the adhesive is brought into contact with an exterior surface of the enclosure assembly, substantially locking the wing extensions in a sealed condition.

20 Claims, 20 Drawing Sheets

(51) Int. Cl.
*B65D 25/22* (2006.01)
*B65D 39/00* (2006.01)

(52) U.S. Cl.
CPC .. *B65D 39/0005* (2013.01); *B65D 2251/0028* (2013.01); *B65D 2251/0081* (2013.01); *B65D 2401/05* (2020.05); *B65D 2571/0066* (2013.01)

(58) Field of Classification Search
CPC .... B65D 2251/0028; B65D 2251/0081; B65D 2571/0066
USPC ..... 220/738; 206/140, 194, 199, 200
See application file for complete search history.

(56) References Cited

U.S. PATENT DOCUMENTS

| | | | | |
|---|---|---|---|---|
| 5,743,389 | A * | 4/1998 | Cutler | B65D 71/44 206/216 |
| 10,064,507 | B1 * | 9/2018 | Shih | B65D 51/18 |
| 10,479,547 | B2 * | 11/2019 | Sumitomo | B65D 5/0254 |
| 10,595,653 | B1 * | 3/2020 | Messilaty | B65D 51/2807 |
| 2001/0010328 | A1 * | 8/2001 | Itey | B65D 5/46104 229/117.15 |
| 2008/0087558 | A1 * | 4/2008 | Libit | B65D 71/0074 206/196 |
| 2014/0262911 | A1 * | 9/2014 | Kooc | B65D 5/46104 206/509 |
| 2017/0129673 | A1 * | 5/2017 | Wintz | B65D 73/0085 |
| 2017/0355501 | A1 * | 12/2017 | Furio | B65D 5/46104 |
| 2019/0352046 | A1 * | 11/2019 | Pohlman | B65D 21/022 |

* cited by examiner

TAMPER EVIDENT ENCLOSURE FOR A FOOD/BEVERAGE CONTAINER AND METHOD

RELATED APPLICATIONS

This application claims priority under 35 U.S.C. § 119(e) from U.S. Provisional Patent Application No. 62/845,705, filed May 9, 2019, which is entitled "TAMPER EVIDENT ENCLOSURE FOR AN UPPER PORTION OF A DISPOSABLE CUP/CONTAINER AND METHOD", naming Tan as the inventor, and which is incorporated by reference in its entirety.

FIELD OF THE INVENTION

The present invention relates to disposable beverage containers, and more particularly, relates to tamper evident enclosures for disposable beverage cups and food containers.

BACKGROUND OF THE INVENTION

Conventional prior art disposable cups 22 and lids 23, as shown in FIG. 1, have been in use in the food industry since at least the commencement of take-out fast food services. These tapered cups typically have upper open mouth portions defined by a circumferential lip portion that easily accommodates a press-on lid that prevents spillage, but also provides simple access to the cups contents.

More recently, these food/beverage container and lids, as well as tapered food containers for soups for example, are commonly used in food and beverage delivery. While the use of these tapered containers and lids continues to proliferate in the food and beverage service industry, especially with the recent growth of third party food and beverage delivery services, the potential for food and beverage tampering also increases. Both the food and beverage preparer/provider and the consumer would like assurance the food and beverage prepared have not in any manner been touched or tampered prior to the delivery.

Accordingly, it is desirable to provide a single use, tamper evident enclosure to cover and conceal the upper mouth portions of disposable beverage cups and food containers in a manner that enables the end consumer assurance that the beverage cup and/or food container has not been opened, and that the prepared food or beverage therein has not been tampered with.

SUMMARY OF THE INVENTION

The present invention provides a tamper evident delivery enclosure assembly for a food/beverage container having a content receiving region, and a circumferential sidewall that tapers radially outward from a lower portion to an upper portion thereof. The circumferential sidewall terminates at an upper circumferential lip portion that defines a mouth portion into the content receiving region of the container. The container also includes a lid that is configured to press-fit mount over the mouth portion thereof. The enclosure assembly includes a thin base portion, defined by a base perimetric edge, and having a seating aperture configured to supportably seat the upper portion of the circumferential sidewall proximate to the lip portion of the container, at a seated position. The seating aperture is further sized such that the lip portion of the container does not pass therethrough. A pair of foldable wing extensions is coupled to generally opposed sections of the base perimetric edge, and is configured to foldably extend upwardly from the base portion, when in the seated position, such that the foldable wing extensions substantially extend over the container mouth portion and mounted lid to form an interior pocket, in an engaged condition. In this orientation, access to the mounted lid, secured in the interior pockets, is substantially prevented. The enclosure assembly further includes a single use closure tape laterally mounted to one of the wing extensions. The closure tape includes an upper lateral portion that extends beyond the wing member in an unsealed condition. The closure tape further includes an adhesive disposed on an interior surface of the tape upper lateral portion, and a removable protective strip that removably covers the adhesive. When the protective strip is removed, and the wing extensions are in the engaged condition, the tape upper lateral portion can be folded over such that the adhesive is brought into contact with an exterior surface of the enclosure assembly, substantially locking the wing extensions in a sealed condition.

Accordingly, a tamper evident delivery enclosure assembly is provided that can be easily sealed to prevent or deter content tampering. This enclosure assembly is particularly useful in the food delivery service industry.

In one specific embodiment, the wing extensions each include a first pre-fold at a location where the wing extensions are coupled to the base portion, and a second pre-fold, generally parallel to the first pre-fold. The first and second pre-folds are spaced-apart a first fold distance that is at least the length as a seated distance, which is the spacing between the base portion and the container lip portion when the enclosure assembly is oriented in the seated position. Preferably, the seated distance is generally in the range of about 0.5 in. to about 1.5 in. vertically from the lip portion of the container.

In another specific embodiment, the tamper evident enclosure assembly further includes a pair of foldable wing protrusions coupled to generally opposed portions of the base perimetric edge. The wing protrusions is oriented generally transverse to the pair foldable wing extensions. Each foldable wing protrusion is configured to foldably extend upwardly from the base portion, when in the seated position, such that the pair of foldable wing extensions substantially extend over the container mouth portion and the mounted lid, in a coupled condition. Hence, the pair of foldable wing extensions, in the engaged condition, and the pair foldable wing protrusions, in the coupled condition, form the interior pocket.

Still another specific embodiment provides the wing extensions and the wing protrusions including a first pre-fold at a location where the associated wing extensions and the associated wing protrusions are coupled to the base portion, and a second pre-fold, generally parallel to the respective first pre-fold. The second pre-fold is spaced apart from the first pre-fold, of the wing protrusions, a second fold distance that is at least the length of the first fold distance.

In this configuration, the base perimetric edge is generally rectangular in shape.

Another configuration provides at least one of the wing extension and the wing protrusion include a tab portion configured to removably retain the wing extensions, in the engaged condition, and the wing protrusions, in the coupled condition, prior to movement of the closure tape to the sealed condition.

In yet another embodiment, the base portion includes a plurality of foldable seating teeth extending radially inward from a seating edge that defines the seating aperture.

In one specific embodiment, a thin adapter insert is provided having an insert perimetric edge configured to fit within the footprint of the base perimetric edge of the base portion. The adapter insert defines an insert aperture having a diameter that is smaller than that of the seating aperture.

In still another specific embodiment, the closure tape includes a tear feature configured to facilitate tearing of the closure tape to open the enclosure device, when in the sealed condition, to thereby provide access to the content receiving region thereof.

In another aspect of the present invention, a tamper evident enclosure assembly is provided for a food/beverage container. The enclosure assembly includes a thin base portion defined by a generally rectangular base perimetric edge, and having a seating aperture configured to supportably seat the upper portion of the circumferential sidewall proximate to the lip portion of the container, at a seated position. In this position, the lip portion of the container is incapable of passing through the seating aperture. A pair of foldable wing extensions are provided that are coupled to generally opposed sections of the base perimetric edge. A pair of foldable wing protrusions are also provided that are coupled to generally opposed portions of the base perimetric edge, oriented generally perpendicular to the pair foldable wing extensions. Each foldable wing extension and each foldable wing protrusion is configured to foldably extend upwardly from the base portion, when in the base portion is in the seated position. The foldable wing extensions and the wing protrusion each substantially extend over the container mouth portion and mounted lid, in this seated condition, to collectively form an interior pocket, in an engaged condition and a coupled condition, respectively that substantially prevent access to the mounted lid. The enclosure assembly further includes a single use closure tape laterally mounted to at least one of the wing extension and the wing protrusion. An upper lateral portion of the closure tape extends beyond the respective wing extension and/or wing protrusion, in an unsealed condition, and includes an adhesive disposed on an interior surface of the tape upper lateral portion. A removable protective strip that removably covers the adhesive. When the protective strip is removed, and the wing extensions are in the engaged condition and the wing protrusions are in the coupled condition, the tape upper lateral portion can be folded over such that the adhesive is brought into contact with an exterior surface of the enclosure assembly. In this sealed condition, the wing extensions and the wing protrusions are substantially locked in place.

In one embodiment, at least one of the wing extension and the wing protrusion includes a tab portion configured to removably retain the wing extensions, in the engaged condition, and the wing protrusions, in the coupled condition prior, to movement of the closure tape to the sealed condition.

In another specific configuration, the wing extensions and the wing protrusions each include a first pre-fold generally at the opposed sections and the opposed portions, respectively, of the base perimetric edge where the wing extensions and the wing protrusions are coupled to the base portion. Each further include a second pre-fold, generally parallel to and spaced apart from the respective first pre-fold a fold distance that is at least the length as a seated distance, generally between the base portion and the container lip portion when the enclosure assembly is in the seated position.

Another specific embodiment provides that at least one of wing extensions and the wing protrusions includes a handle portion.

In yet another embodiment, the enclosure assembly includes a thin adapter insert having an insert perimetric edge configured to fit within the footprint of the base perimetric edge of the base portion. The adapter insert defines an insert aperture having a diameter that is smaller than that of the seating aperture.

The base portion includes a plurality of foldable seating teeth extending radially inward from a seating edge which defines the seating aperture. The adapter insert includes a plurality of foldable seating tabs extending radially inward from an interior insert edge which defines the insert aperture.

Still another arrangement provides a closure tape that includes a tear feature configured to facilitate tearing of the closure tape to open the enclosure assembly, when in the sealed condition, to thereby provide access to the content receiving region of the delivery enclosure assembly. The tear feature includes scoring of the closure tape.

In still another aspect of the present invention, a tamper evident method is provided for delivering a food beverage/container comprising providing the above mentioned enclosure assembly, and placing the lower portion of the food/beverage container into the seating aperture of the base portion until the upper portion of the container is seated at the seating position. The method next includes folding each wing protrusion upwardly from the base portion over the mounted cup lid, and inwardly toward one another in a manner such that the foldable wing protrusion each substantially extend over the container mouth portion and mounted lid in a coupled condition. The method includes folding each wing extension upwardly from the base portion over the mounted cup lid, and inwardly toward one another in a manner such that the foldable wing extension each substantially extend over the container mouth portion and mounted lid in an engaged coupled condition. The wing protrusions in the coupled condition and the wing extensions in the engaged condition collectively forming an interior pocket that substantially prevents access to the mounted lid. The method next includes removing the protective strip from the upper lateral portion of the closure tape, exposing the adhesive, in the unseal condition, and then contacting the exposed adhesive with an exterior surface of the enclosure assembly, substantially locking the wing extensions and the wing protrusions in a sealed condition.

The method further includes at least one of coupling the wing protrusion together in the coupled condition and engaging the wing extension together in the engaged condition prior to contacting the exposed adhesive to the sealed condition.

BRIEF DESCRIPTION OF THE DRAWINGS

The assembly of the present invention has other objects and features of advantage which will be more readily apparent from the following description of the best mode of carrying out the invention and the appended claims, when taken in conjunction with the accompanying drawings, in which:

DETAILED DESCRIPTION OF THE INVENTION

Figure 1:
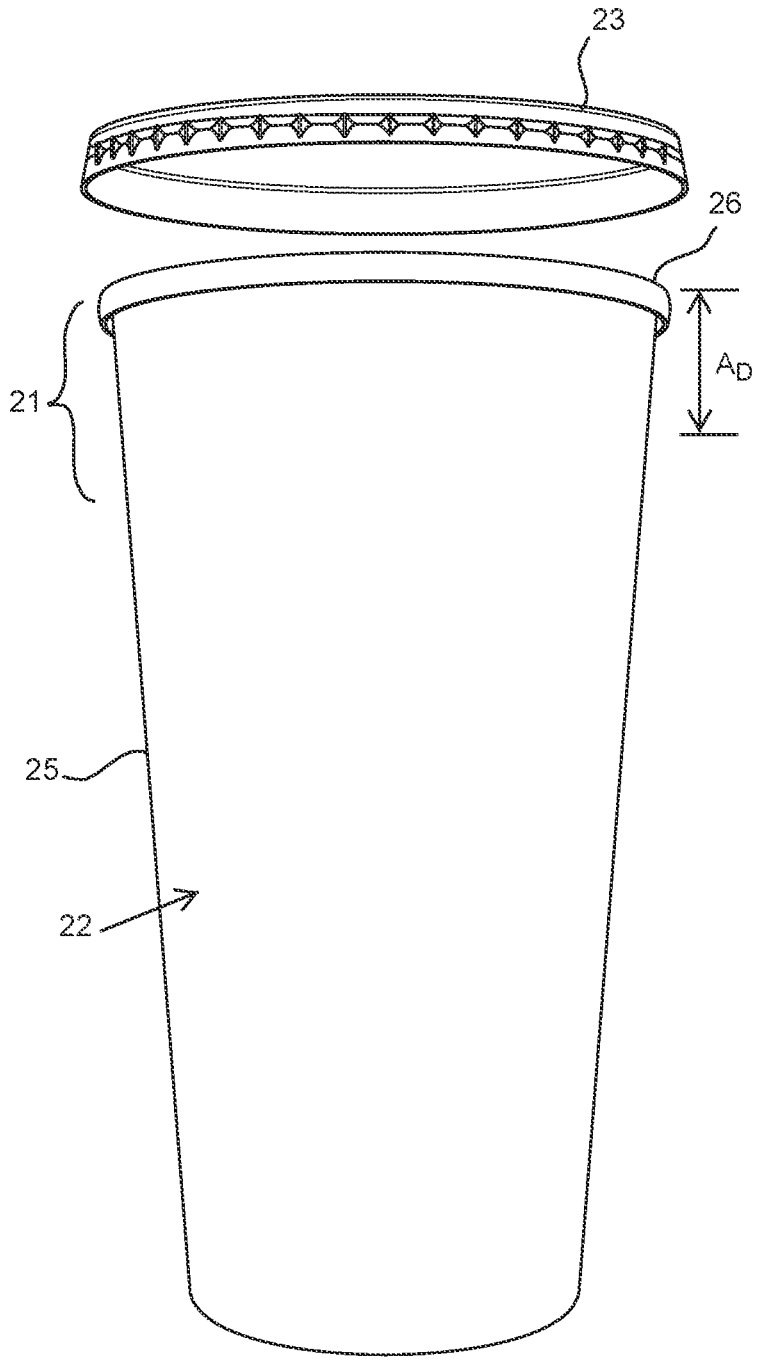
FIG. 1 (Prior Art)
FIG. 1 is a front elevation of a prior art container and mounted lid.

While the present invention will be described with reference to a few specific embodiments, the description is illustrative of the invention and is not to be construed as limiting the invention. Various modifications to the present invention can be made to the preferred embodiments by those skilled in the art without departing from the true spirit and scope of the invention as defined by the appended claims. It will be noted here that for a better understanding, like components are designated by like reference numerals throughout the various figures.

Turning now to FIGS. 2-7, a one-time sealed tamper evident enclosure assembly 20 is provided to enclose, encompass and securely seal the upper portion 21 of a conventional opened top disposable beverage cup and/or food container 22 and its press-on lid 23 (FIG. 1), shielding the same from direct exposure. Any evidence of tampering of the enclosure assembly will be clearly evident, prior to delivery, via a broken or deformed seal or the like. This tamper evident enclosure assembly 20 is configured to cooperate with a conventional, prior art, beverage cup or food container 22 (FIG. 1) that has tapered sidewalls 25 which taper radially outward from a bottom base or lower portion of the cup to an upper portion 21 thereof to protect its contents therein from tampering.

Briefly, the present invention will be described hence forth with respect to only the beverage cup container for clarity, which further typically include an upper lip portion 26 (FIGS. 1 and 10) that defines a mouth portion 27 extending into a content receiving region. It will further be appreciated that the present invention enclosure assembly can be applied to other tapering food containers, such as a larger diameter soup container, or with other non-circular perimeter containers footprints, such a traditional rectangular Chinese take-out container.

Referring now to FIGS. 2-7, the enclosure assembly 20 includes a thin base portion 28 defined by a base perimetric edge 31. Within the base portion 28 is a seating aperture 30 extending therethrough which is sized and configured to supportably seat an upper portion 21 of the circumferential sidewall 25 proximate to the lip portion 26 of the container 22, at a seated position (E.g., FIGS. 2, 5, 6, 14), such that the lip portion 26 of the container does not pass through the seating aperture 30. The enclosure assembly further includes a pair of foldable wing extensions 32, 33 coupled to generally opposed sections of the base perimetric edge 31. These opposed wing extensions 32, 33 are configured to foldably extend upwardly from the base portion 28, when in the seated position relative to the container 22, in a manner such that, collectively, they substantially extend over the container mouth portion 27 and mounted lid 23 to form an interior pocket, in an engaged condition (e.g., FIGS. 7, 12, 14, 16), that substantially prevents access to the mounted lid 23.

In accordance with the present invention, a single use closure tape 35 is laterally mounted to one of the wing extensions 32, 33. The closure tape includes an upper lateral portion 36 extending laterally beyond the distal portion of the wing member, in an unsealed condition (FIG. 7), where an adhesive on the underside of the upper lateral portion 36 of the closure tape includes a removable protective strip 37 that removably covers the adhesive so as not to prematurely adhere or affix to anything. When the protective strip 37 is removed, and the wing extensions are in the engaged condition, the tape upper lateral portion can be folded over such that the exposed adhesive is brought into contact with an exterior surface portion of the enclosure assembly 20, substantially locking the wing extensions in a sealed condition.

Accordingly, an enclosure assembly is provided that fully encloses the upper portion and mounted lid of a container, and that can be easily one-time sealed to show any evidence of tampering. This enclosure assembly is particularly useful in the food delivery service industry to significantly reduce and/or deter tampering with the container contents without tearing of the closure tape or wing extensions.

Figure 6:
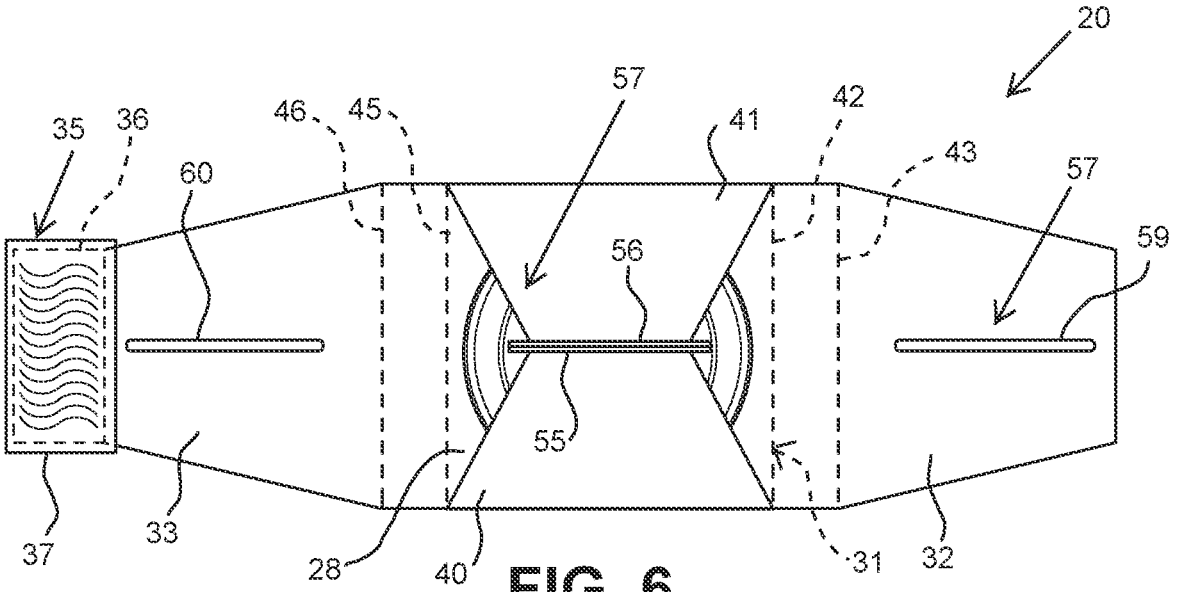
FIG. 6 is a top plan view of enclosure assembly of FIG. 4 with a pair of wing protrusions thereof in a coupled condition.

More preferably, the enclosure assembly of the present includes at least three wings triangularly oriented (not shown), and most preferably four wings rectangularly oriented, to assure complete enveloping the enclosed mounted lid 23. Hence, as best shown in the remaining embodiments of FIG. 2-27, the enclosure assembly 20 also includes a pair of foldable wing protrusions 40, 41 aligned and oriented generally perpendicular to the first pair of wing extensions 32, 33. These foldable wing protrusions 40, 41 are coupled to the opposed portions of the base perimetric edge 31, and can be first be folded up and over the container and mounted lid 23 to engage one another, in a coupled condition (FIG. 6). Subsequently, the wing extensions 32, 33 can then be folded up and over the container and mounted lid, to engage one another, in the engaged condition (FIG. 7), collectively forming the interior pocket. Accordingly, in this configuration, the base portion 28 is preferably generally rectangular, and more preferably square in shape.

The base portion 28 is relatively thin, as are the integral wing extensions 32, 33 and protrusions 40, 41, and is preferably comprised of a thicker paper or thinner cardboard structure capable of folding. It will be understood that that other suitable materials could be a thin foldable plastic sheet-like material or the like.

The base portion 28 defines the relatively circular seating aperture 30 which has a diameter slightly smaller than that of the upper circumferential lip portion 26 that defines the container mouth portion 27. Accordingly, when the bottom of the container 22 is positioned axially through the seating aperture 30, the base portion 28 can slide up the tapered sidewall 25 until the diameter of the seating aperture and that of the outer circumferential sidewall generally match one another so as to make seating contact, and prevent further axial movement there along. The base portion 28, thus, can be oriented along the upper portion 21 of the outer circumferential sidewall 25 proximate to the container lip portion 26, in the seated condition, while not permitting the passage of the container through the seating aperture 30. This seating position enables the two pair of opposed, foldable wing extensions 32, 33 and wing protrusions 40, 41, integrated with the corresponding opposed sections of the base perimetric edge 31, to be folded up and over the container upper portion 21 and mounted lid 23 of the cup assembly (e.g., FIGS. 7, 13, 15, 17), enclosing the same therein within the interior pocket defined therein. The folded structure enclosing the upper portion 21 and mounted lid 23 can subsequently sealed with the single use integrated adhesive strip or closure tape 35 that will show evidence any delivery personnel tampering should any unwanted entry be attempted, in the sealed condition (e.g., 13, 15, 17, 21, 24).

In one particular embodiment, the diameter of the seating aperture 30 is in the range of about 2.0 in. to about 5.0 in. This distance will permit the accommodation of a variety of different height, and differently tapered containers, and when the container is oriented in the seating position, the enclosure base portion 28 will be a seated distance ($A_D$) (FIG. 1) in the range of about 0.5 in. to about 1.5 in. vertically from the upper lip portion 26 of the container 22. However, if the seating aperture diameter is too small, the base portion 28 would be vertically seated much too low axially along the tapered circumferential sidewall 25. This would place the base portion distally too far from the container lip portion, and require a significant lengthening of the wing extensions 32, 33 and wing protrusions 40, 41 to fabricate an interior pocket sufficient to enclose the mounted lid 23. On the other hand, should the seating aperture diameter be too large, the base portion 28 of the enclosure may not seat properly against the container sidewall 25 so as to be unstable, or all the container to slip portion through the seating aperture altogether.

Figure 3:
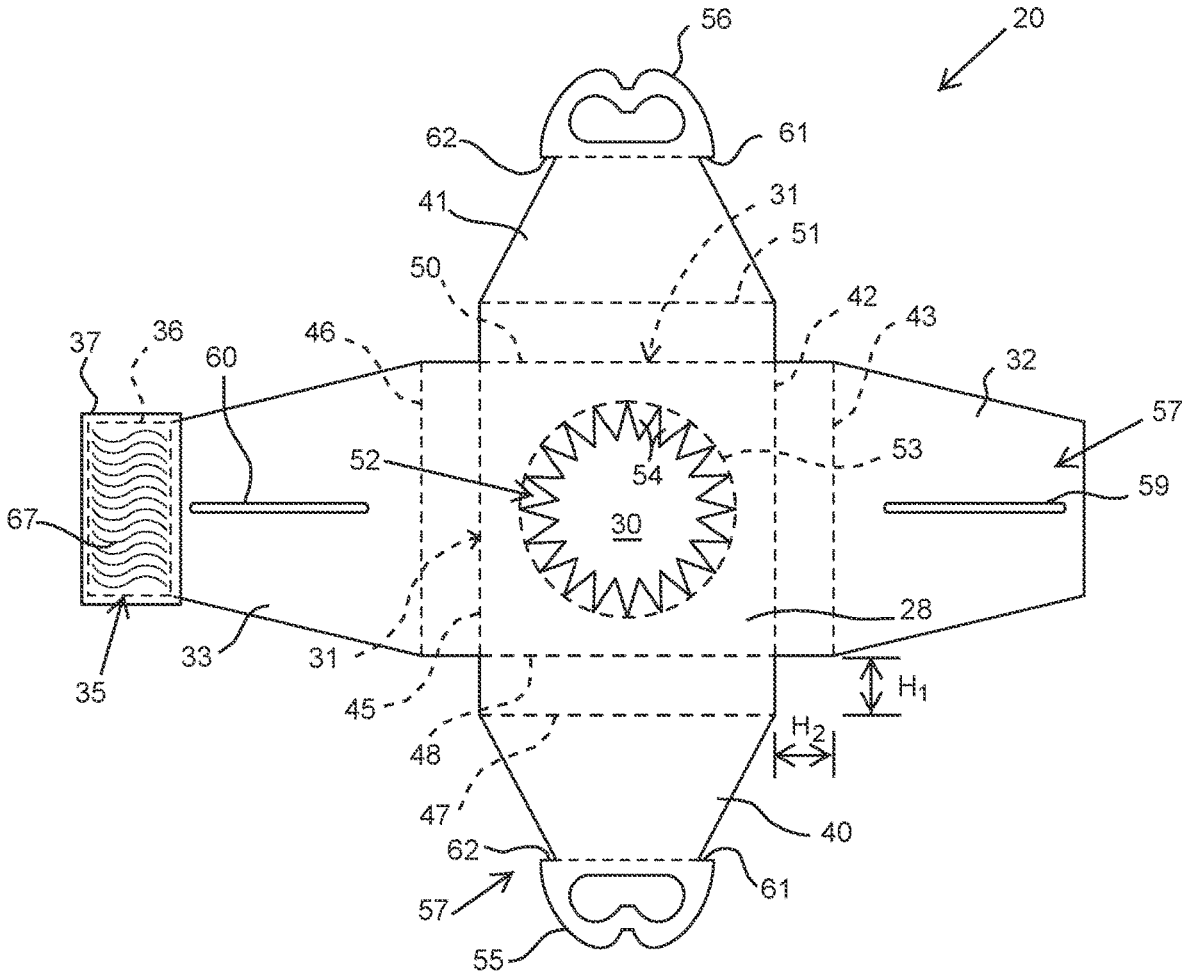
FIG. 3 is a top plan view of one embodiment of the tamper evident enclosure assembly of the present invention.
Figure 4:
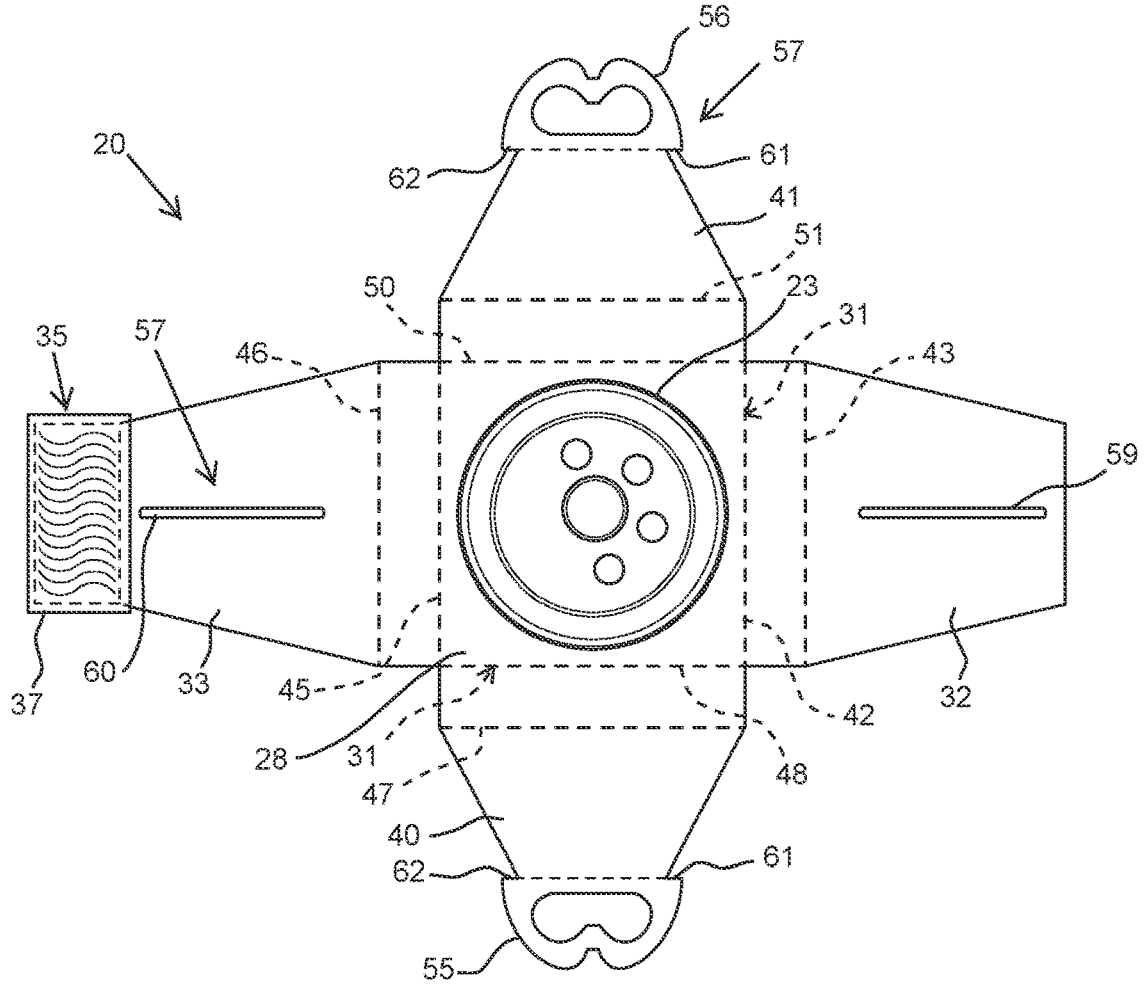
FIG. 4 is a top plan view of one embodiment of FIG. 3 with the container in a seated position with tamper evident enclosure assembly.
Figure 5:
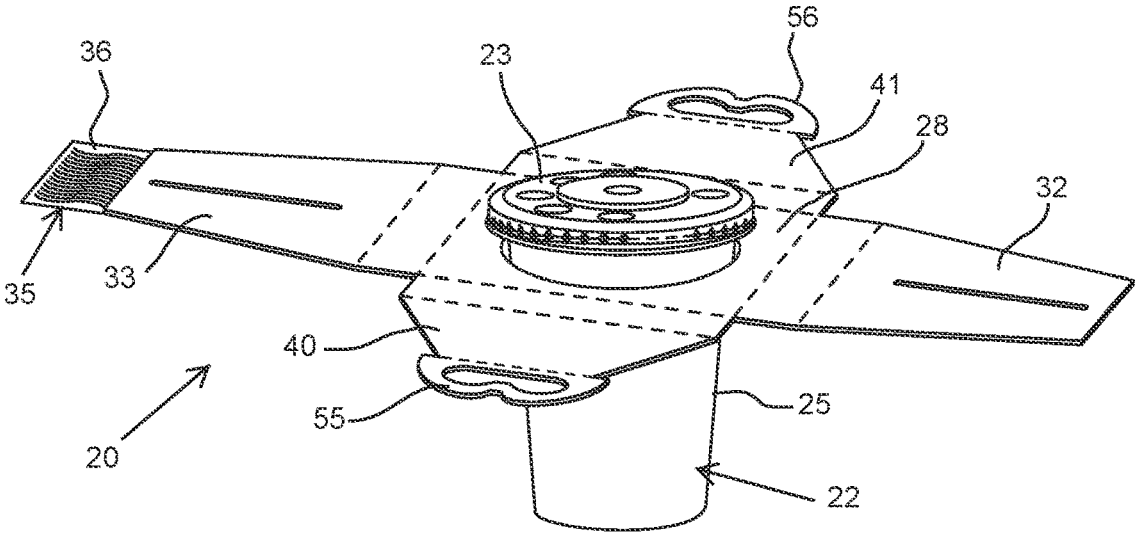
FIG. 5 is a top perspective view of the enclosure assembly of FIG. 4 illustrating the container in the seated position.

To promote and facilitate proper foldability of the wing extensions 32, 33 and wing protrusions 40, 41 toward the engaged condition and coupled condition, respectively, each wing 32, 33 extension and each wing protrusion 40, 41 includes a pair of spaced-apart lower and upper pre-folds 42, 43 and 45, 46, and 47, 48 and 50, 51, respectively (FIGS. 3 and 4). These pre-folds enable the associated wings to be bent 90°, at predetermined locations, to collectively form a substantially rectangular prism-shaped interior pocket so that the container upper portion 21 and mounted lid 23 to be enclosed therein.

It will be appreciated that a transverse distance ($H_1$) (FIGS. 2 and 3) between the adjacent, spaced-apart pre-folds 47, 48 and 50, 51 of each wing protrusions 40, 41 and a transverse distance ($H_2$) (FIGS. 2 and 3) between the adjacent, spaced-apart pre-folds 42, 43 and 45, 46 of each wing extension 32, essentially determine the pocket height of the interior pocket formed. This pocket height, hence, is part of the equation to help determine the length dimension of the seated distance ($A_D$) (FIG. 1), in the seated condition, and vice versa, proximate to the upper lip portion 26 of the container 22. Collectively, the pocket height, the base portion 28 dimensions determine whether the wing protrusions 40, 41 and the wing extensions 32, 33, are capable of being folded to the coupled condition and engaged condition to fully enclose the mounted lid 23 and container upper portion 21 therein.

The transverse distances $H_1$ and $H_2$ between the lower and upper pre-folds 42, 43 and 45, 46 of the wing protrusions 40, 41 and the lower and upper pre-folds 47, 48 and 50, 51 of the wing extensions 32, 33 are required to be at least the length of the seated distance $A_D$ of the base portion 28 and the upper lip portion 26, in the seated position. More preferably, however, the transverse distances $H_1$ and $H_2$ are relatively greater than the axial distance $A_1$ to accommodate a greater variety of beverage cups and/or food containers. In one example, transverse distances $H_1$ and $H_2$ are in the range of about 0.5 in. to about 1.5 in. while the axial distance $A_1$ is in the range of about 1.0 in. to about 3.0 in. Moreover, it will be appreciated that the transverse distance $H_2$ of the wing extensions may be slighter greater than the transverse distance $H_1$ between wing protrusions since the wing extensions are generally folded atop the wing protrusions.

To accommodate a wider range of container diameters, the base portion 28 may includes an integral tension sleeve 52 that extends radially inward from a seating edge 53 that defines the seating aperture. This foldable sleeve 52 is configured to increasingly contact the circumferential sidewall 25 as the container is moved toward the seating condition. Retaining contact can occur with the sideways of the container prior to full placement at the seating edge 53. Accordingly, the range of locations of the seating condition along the container tapered sidewall is widened.

Figure 2:
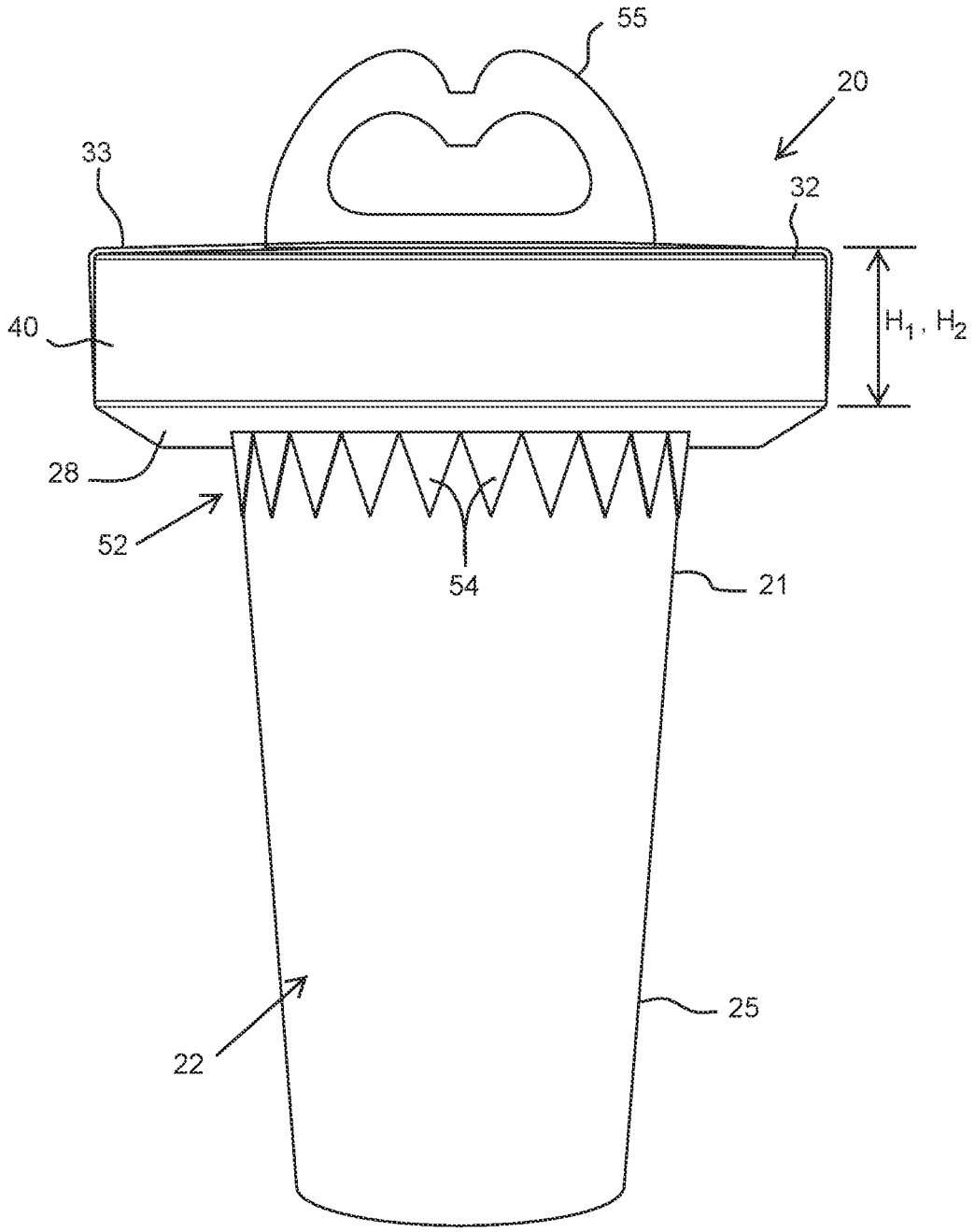
FIG. 2 is a front elevation view of the container of FIG. 1, with a tamper evident enclosure device mounted thereto constructed in accordance with the present invention.

As best illustrated in FIG. 3, the tension sleeve 52 may include a plurality of foldable square (FIG. 27) or triangular-shaped teeth seating 54. As mentioned, these teeth 54 function to increasingly contact the tapered sidewall 25 as the container is pushed further axially through the aperture (FIG. 2). Accordingly, this collective tension sleeve 52 not only functions to accommodate different diameter containers, but also functions to tension retain the base portion 28 along the tapered sidewall 25 at different vertical orientations there along.

Referring back to the embodiment of FIGS. 4-7, once the tension sleeve 52 and base portion 28 are seated against the container tapered sidewalls 25 at the container upper portion 21, in the seated condition (FIG. 5), the opposed wing protrusions 40, 41 are first folded at lower pre-folds 47, 50 lining the base portion 28 at the opposed portions. Nearly simultaneously, the upper pre-folds 48, 51 of the wing protrusions 40, 41 are folded towards one another until the corresponding handle portions 55, 56, at the distal portions of the wing protrusions 40, 41, can be oriented adjacent and aligned with one another (FIG. 6). As previously indicated, the transverse distance ($H_1$) between the associated lower and upper pre-folds 47, 48 and 50, 51 of each wing protrusions 40, 41, provide the vertical height to extend up and over the mounted lid 23 and container upper portion 21, while the distal portions of the wing protrusions (distal to the upper pre-folds 48, 51) provide the horizontal dimensions to laterally cover the mounted lid, forming a portion of the interior pocket.

Figure 7:
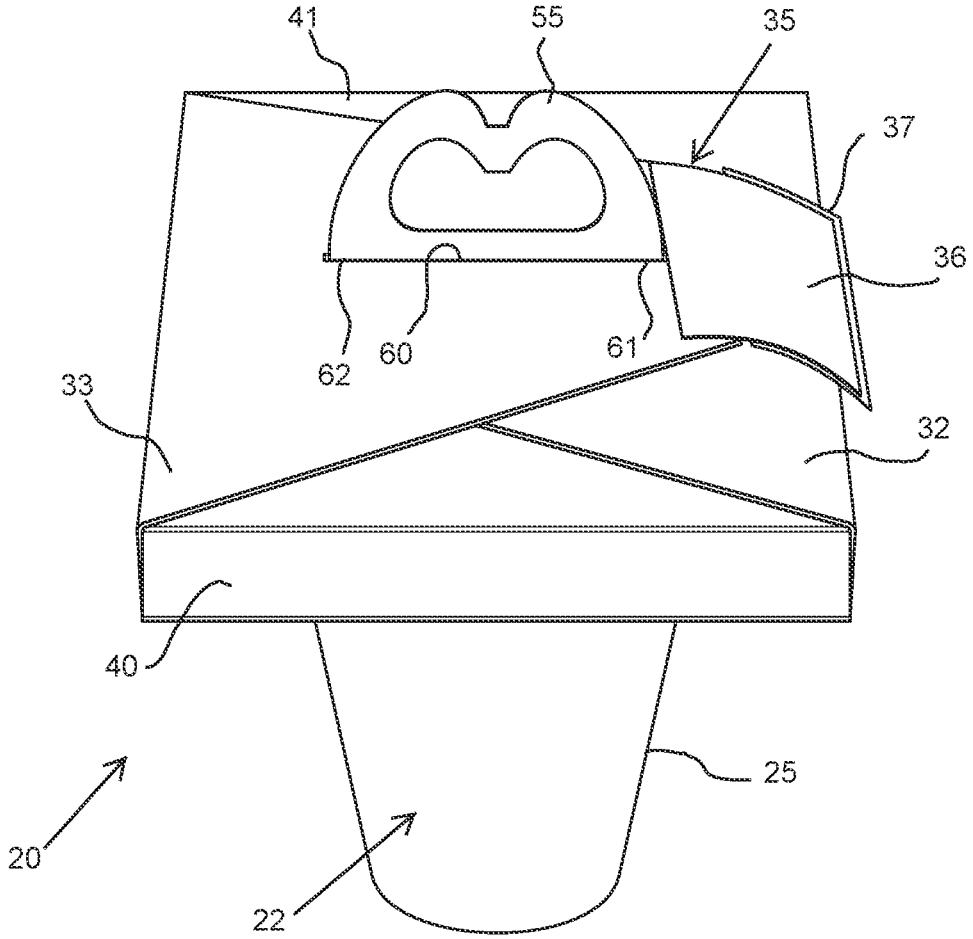
FIG. 7 is a top perspective view of the enclosure assembly of FIG. 6 with a pair of wing extensions thereof in an engaged coupled condition.

Similarly, after the wing protrusions are moved to the coupled condition (i.e., FIG. 6), the opposed wing extensions 32, 33 are then first folded at lower pre-fold 42, 45 lining the base portion 28 at the opposed sections. Nearly simultaneously, the associated upper pre-fold 43, 46 of the wing extensions 32, 33 are folded and bent towards one another until the corresponding distal portions of the wing extensions are oriented adjacent and aligned atop one another (FIG. 7, in the engaged position). As previously mentioned, the distal portions of the wing extensions provide the horizontal dimensions to laterally cover the mounted lid.

In accordance with the present invention, either the wing protrusions or wing extensions, or both, may incorporate tab portions 57 configured to retain the same in the coupled condition (FIGS. 6, 11), and/or the engaged condition (FIGS. 7, 15, 17, 21, 24-27), respectively. These tab portions 57 cooperate with the wing protrusions and wing extensions to removably retain the same together and/or to the other transverse wings so that the closure tape 35 may be applied to seal the enclosure assembly for delivery transport. For example, in the embodiment of FIGS. 4-7, the tab portions 57 include the removable engagement between the adjacent handle portions 55, 56 at the distal portion of the wing protrusions 40, 41, in the coupled condition shown in FIG. 6, and the corresponding receiving slits 59, 60 defined by the wing extensions 32, 33, in the engaged condition (FIG. 7). Accordingly, the receiving slits are sized and dimensioned to permit the simultaneous insertion of the handle portions 55, 56 therethrough, in the engaged condition.

The tab portions 57 may also include lower lock ledges 61 and 62 in the handle portions 55, 56 which cooperate with the distal end edges defining the slits 59, 60 to releasably lock the wing extensions with the handle portions 55, 56 of the wing protrusions 40, 41 (FIGS. 4 and 7), in the engaged condition.

Figure 12:
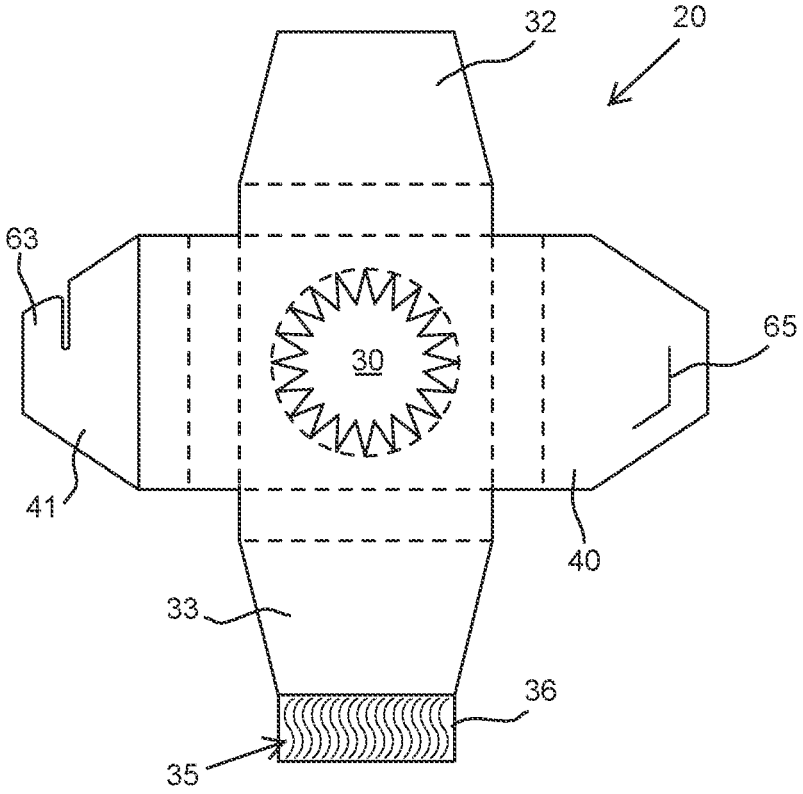
FIG. 12 is a top plan view of an alternative embodiment enclosure assembly.

In another example in the embodiment of FIG. 12, the tab portion 57 is provided by the integral latch 63 and corresponding slot 65 in the opposed wing protrusions 40, 41. These embodiments will be described in greater detail below. In yet another embodiment of FIGS. 14 and 15, by way of example, the tab portions 57 are located in the handle portions 55, 56 of the wing extensions by way of a handle tab 66 that can be folded over the underside of the opposed handle portion 56 for coupling therebetween, in the engaged condition.

Collectively, the engaged wing protrusions 40, 41 and wing extensions 32, 33, in the coupled and engaged conditions, respectively, define the interior pocket to enclose the mounted lid and container upper portion 21 therein. It will be appreciated that at this juncture, however, that the wing protrusions 40, 41 and wing extensions 32, 33 are only removably retained in the coupled and engaged condition by the tab portion 57 and access to the container's contents are still not secured.

In accordance with the present invention, however, at least one of the wing extensions includes a predisposed, single-use, closure tape 35, which can now be applied to secure the wing protrusions and wing extensions together, from an unsecured condition (FIG. 7) to a secured, sealed position (e.g., FIGS. 13, 15, 17, 21). This accomplished by removing the protective strip 37, in the unsealed condition of FIG. 7, to expose the adhesive. The closure tape than can be secure to the one wing extension 33 or other components of the enclosure assembly 20. Any attempt to remove the secured closure tape 35, in the sealed condition, thus, will show evidence of any tampering via tearing, deforming, etc.

The character and properties of the adhesive of the closure tape 35 is preferably similar to that of the relatively strong adhesives and adhesive tapes employed for those used on overnight delivery packages, for instance. That is, the adhesive strength must be sufficiently strong so that any attempt to open the enclosure would show visible signs of tampering (e.g., stretching, tearing, etc. of the bag material and/or closure adhesive). Suitable closure adhesive tape materials include, for example, 3M® 9086, 9888T, CT6348, 9088, 9088FL, and 55256 double-sided adhesive.

In one configuration, the closure tape 35 includes strategic cuts or scoring 67 (e.g., better shown in FIGS. 3-6, 10, 12) to easily cause breakage of the closure tape should removal of the tape be attempted. Such scoring, thus, easily shows any evidence of tampering due to visual separation of the scored portion of the tape 35 should tampering of the closure tape be attempted. While the scoring 67 is shown in the figures as a plurality of adjacent S-shaped slits that extend traversely across the closure tape, the scoring marks can be provided by any convention designs. For example, the slits may be in the form of designs. In one specific example, more distinctive designs include lettering or the like, and can provide personal advertising.

In accordance with the present invention, to accommodate an even wider range of container diameters, a shim tension insert 68 (FIG. 8-11) may also be provided that functions to effectively reduce the size of the base seating aperture 30 so that the same enclosure assembly 20 can accommodate smaller sized containers. That is, rather than providing three different size enclosure assemblies for a small, medium or large food/beverage container 22, for example, a shim insert 68 can be provided that enables the base portion 28, having a seating aperture 30 configured to seat a large sized container, to accommodate a small sized container 22 (FIG. 10) where the diameter at the upper portion of the container might be smaller.

Figure 8:
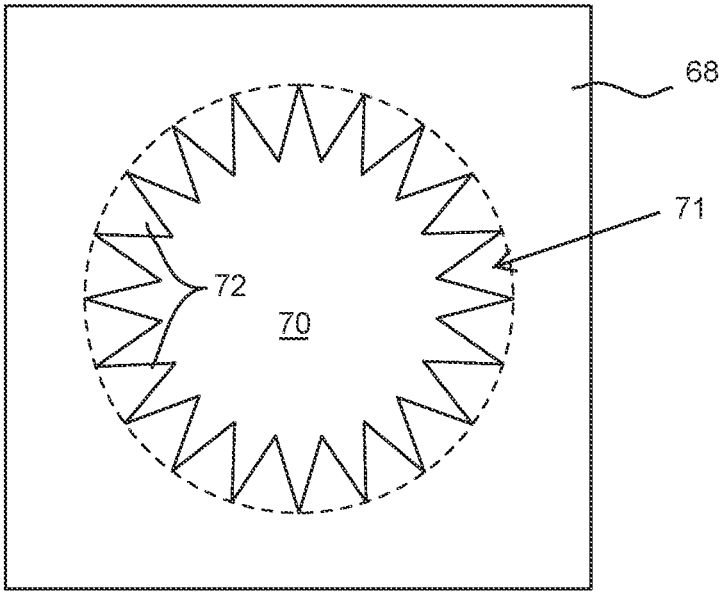
FIG. 8 is a top plan view of an adapter insert to be used with the enclosure assembly of FIG. 2.
Figure 9:
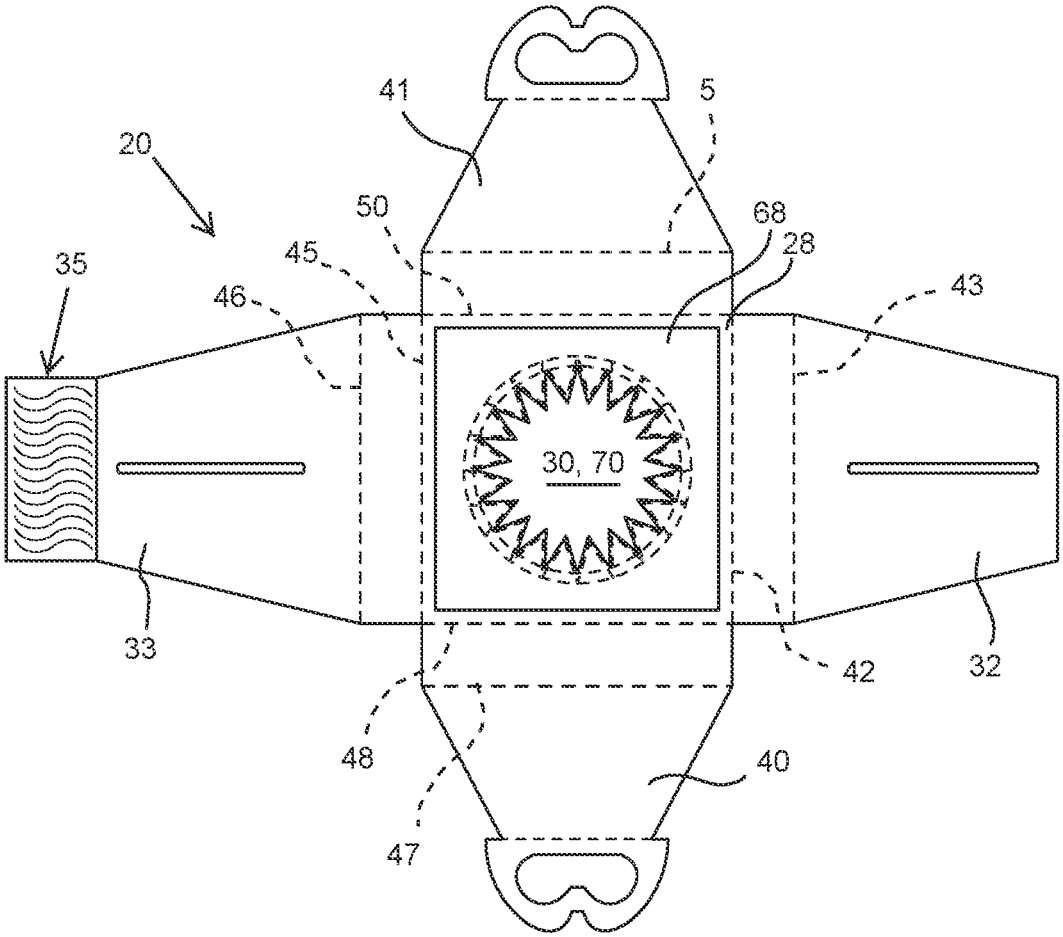
FIG. 9 is a top plan view of the enclosure assembly of FIG. 4 with the adapter insert of FIG. 8.
Figure 10:
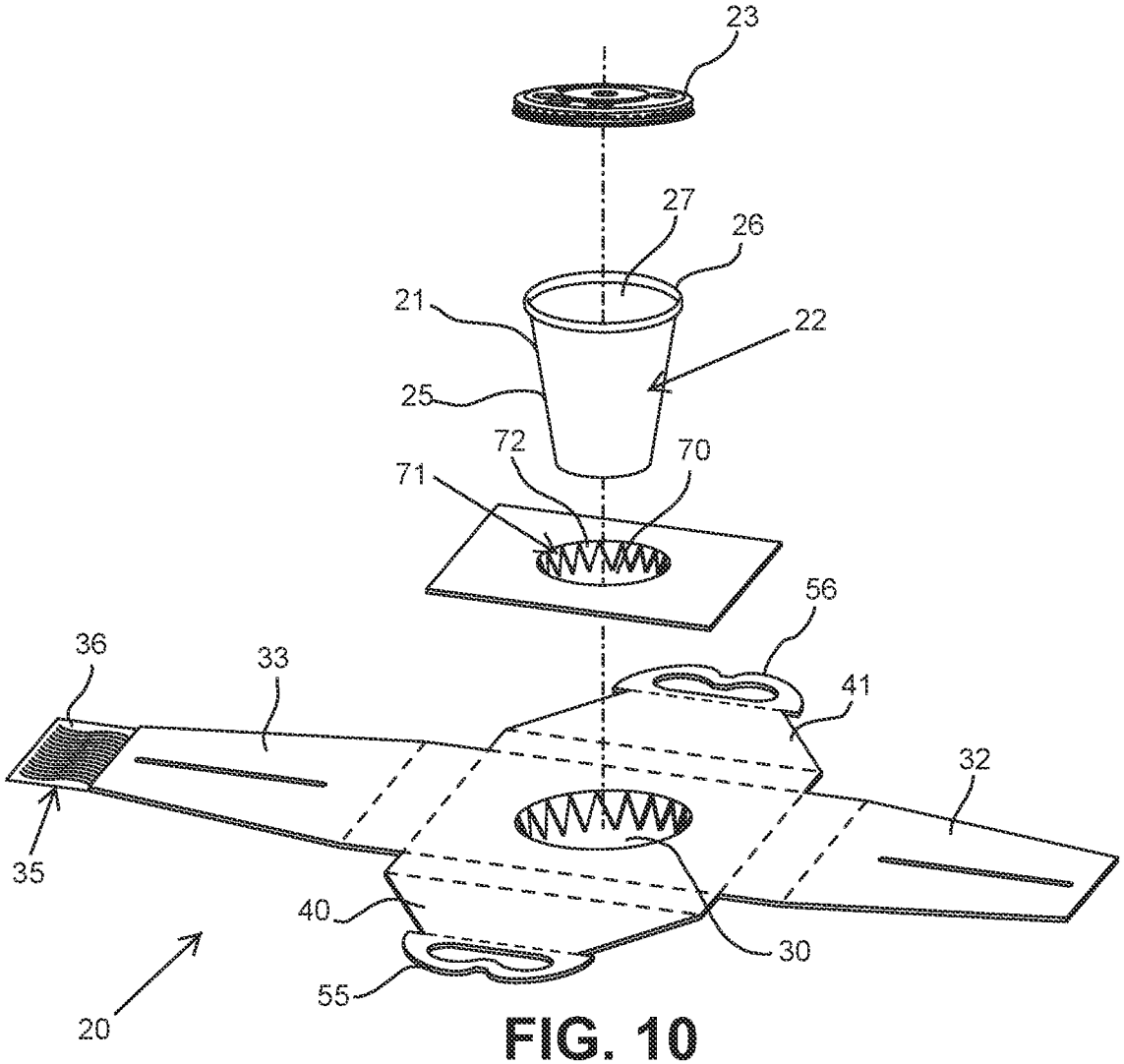
FIG. 10 is an exploded, front perspective view of the enclosure assembly and adapter insert of FIG. 9 together with the container.

As best shown in FIGS. 9 and 10, the shim insert 68 is relatively thin, and includes a perimetric footprint substantially similar in shape to, but slightly smaller than that of the base portion. The shim insert 68 defines an insert seating aperture 70 that is smaller in diameter than that of the base seating aperture 30 of the base portion 28, enabling seating contact with a smaller diameter container. Hence, a smaller or shorter height container 22 may be accommodated. Similar to the base portion 28, the insert 68 may include an insert tension sleeve 71 extending radially into the insert seating aperture 70. FIGS. 8 and 10 best illustrates that the tension sleeve 71 is similarly provided by a plurality of triangular-shaped seating teeth 72 extending radially into the insert seating aperture 70.

Figure 11:
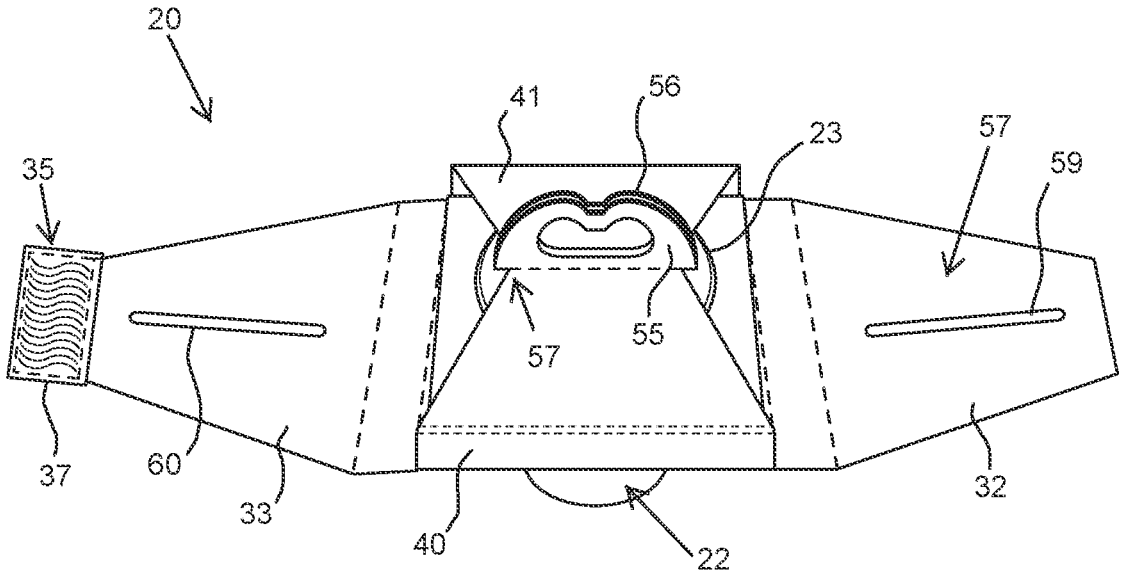
FIG. 11 is a front perspective view of the enclosure assembly and adapter insert of FIG. 10 with the pair of wing protrusions thereof in a coupled condition.

To employ the shim insert 68, the bottom of the container 22 is first placed into the insert seating aperture 70 until the tapered sidewall 25 of the smaller (or shorter, smaller diameter) container 22 seats against the insert tension sleeve 71 of the insert, proximate to the container upper portion 21. Subsequently, container 22 with the shim tension insert 68 can be placed through the base seating aperture 30 until the bottom facing wall of the shim tension insert abuts or contact the upper facing wall of the base portion 28 (FIG. 11).

Accordingly, rather than the base seating aperture 30 being seated all the way up to the container upper lip portion 26, or having the smaller diameter container passing therethrough, the shim insert will prevent this, allowing the enclosure assembly to be employed. Subsequently, the enclosure assembly 20 can be assembled as described above, and as shown in FIG. 11.

Figure 13:
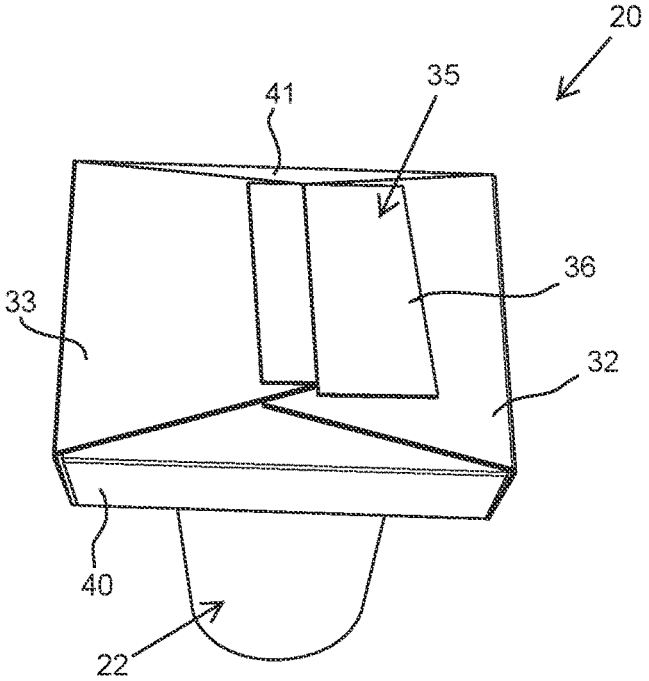
FIG. 13 is a front perspective view of the enclosure device of FIG. 12 mounted to a container.

Referring now to FIGS. 12 and 13, an alternative embodiment enclosure assembly 20 is provided that does not include an integral handle with either the wing protrusions 40, 41 or the wing extensions 32, 33. In this configuration, the tab portion 57 is provided by a conventional interlocking structure on the wing protrusions 40, 41 with a latch portion 63 and interlocking slot 65 to removably latch together.

In this particular embodiment, once the wing extensions 32, 33 are moved to the engaged condition, the protective strip is removed from the closure tape 35 to expose the adhesive. The closure tape 35 can then be applied to secure the wing extensions together and to the enclosure assembly, in the seal condition, as shown in FIG. 13.

Figure 14:
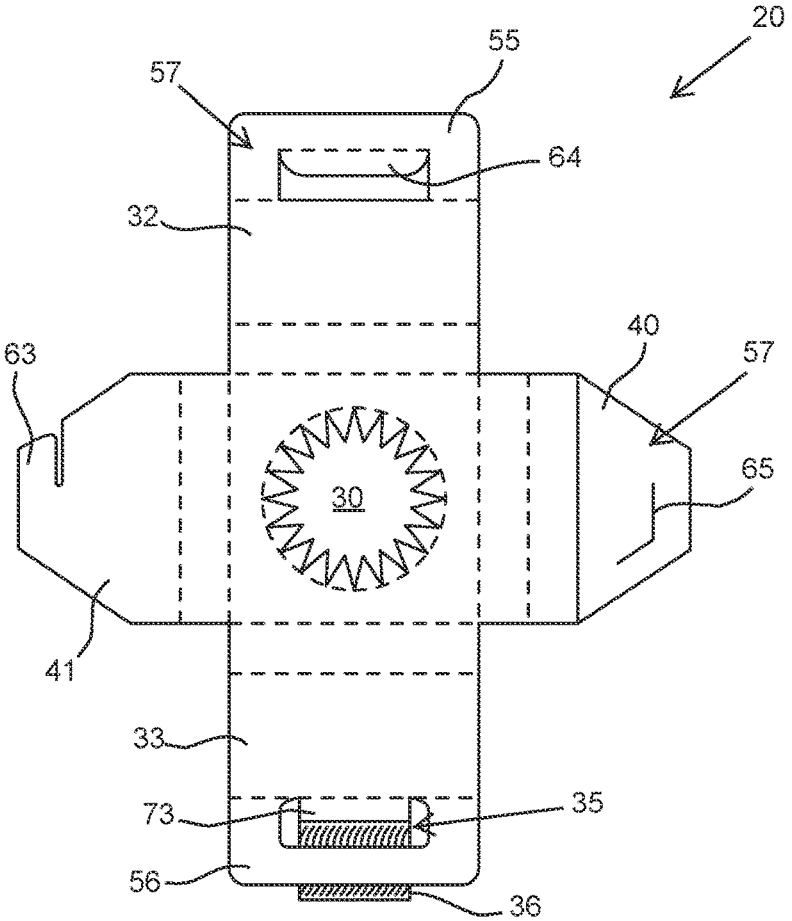
FIG. 14 is a top plan view of an alternative embodiment enclosure assembly.
Figure 15:
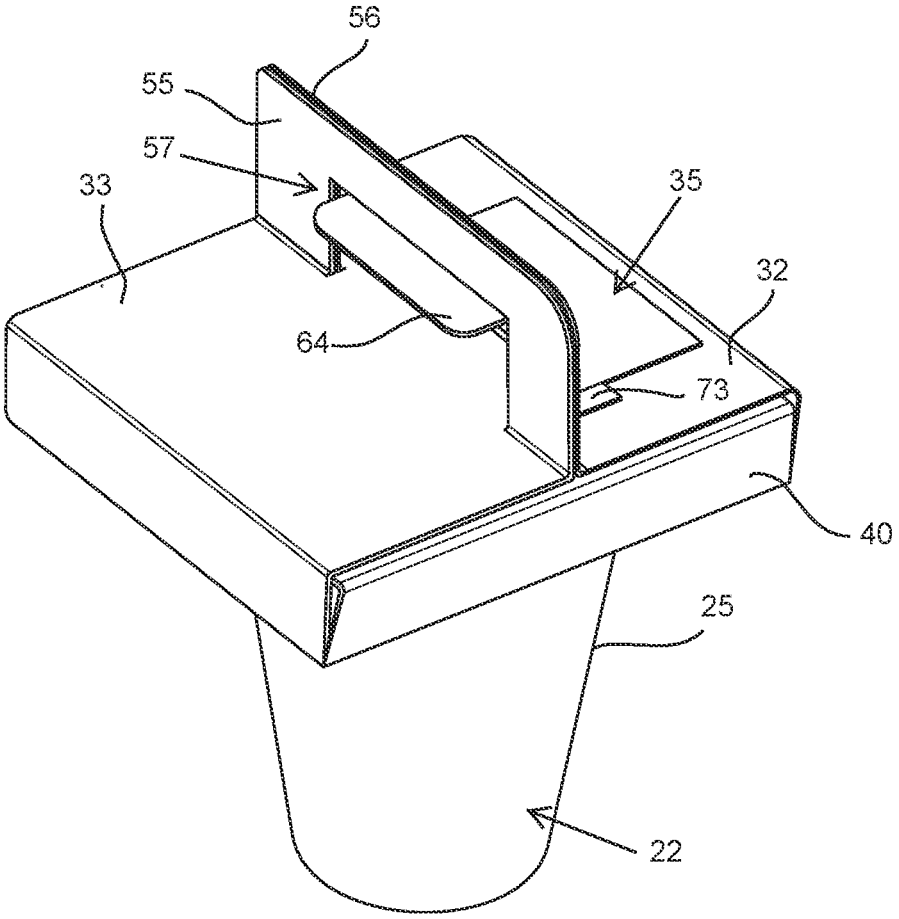
FIG. 15 is a top perspective view of the enclosure assembly of FIG. 14 mounted to the container.

The embodiment of FIGS. 14 and 15 illustrate another alternative enclosure assembly 20 where both the wing protrusions 40, 41 and the wing extensions 32, 33 include tab portions 57. The tab portion 57 of wing protrusions 40, 41 include an aligned latch 63/slot 65 tabs. When the wing protrusions 40, 41 are oriented adjacent and aligned with one another, extending over the mounted lid 23 and container upper portion 21, the latch 63 of the one wing protrusion 40 can be inserted into, and removably locked with, the latch slot 65 of the other wing protrusion 41, in the coupled condition. Subsequently, the wing extensions 32, 33 can be moved toward the engaged condition (FIG. 15). In this embodiment, both wing extensions include distal handle portions 55, 56 that incorporate a tab portion 57 in the form of a handle tab 64 to couple the handles together on wing extension 32, and a tongue latch 73 on extension 33. For instance, once the handle portions 55, 56 are oriented adjacent one another, the handle tab 64 that is integral with one handle portion 55 can be folded under the other handle portion 56 to latch of the adjacent handle portions together, in the engaged condition. The other wing extension 33 includes the tongue latch 73 upon which the closure tape can be attached.

Figure 16:
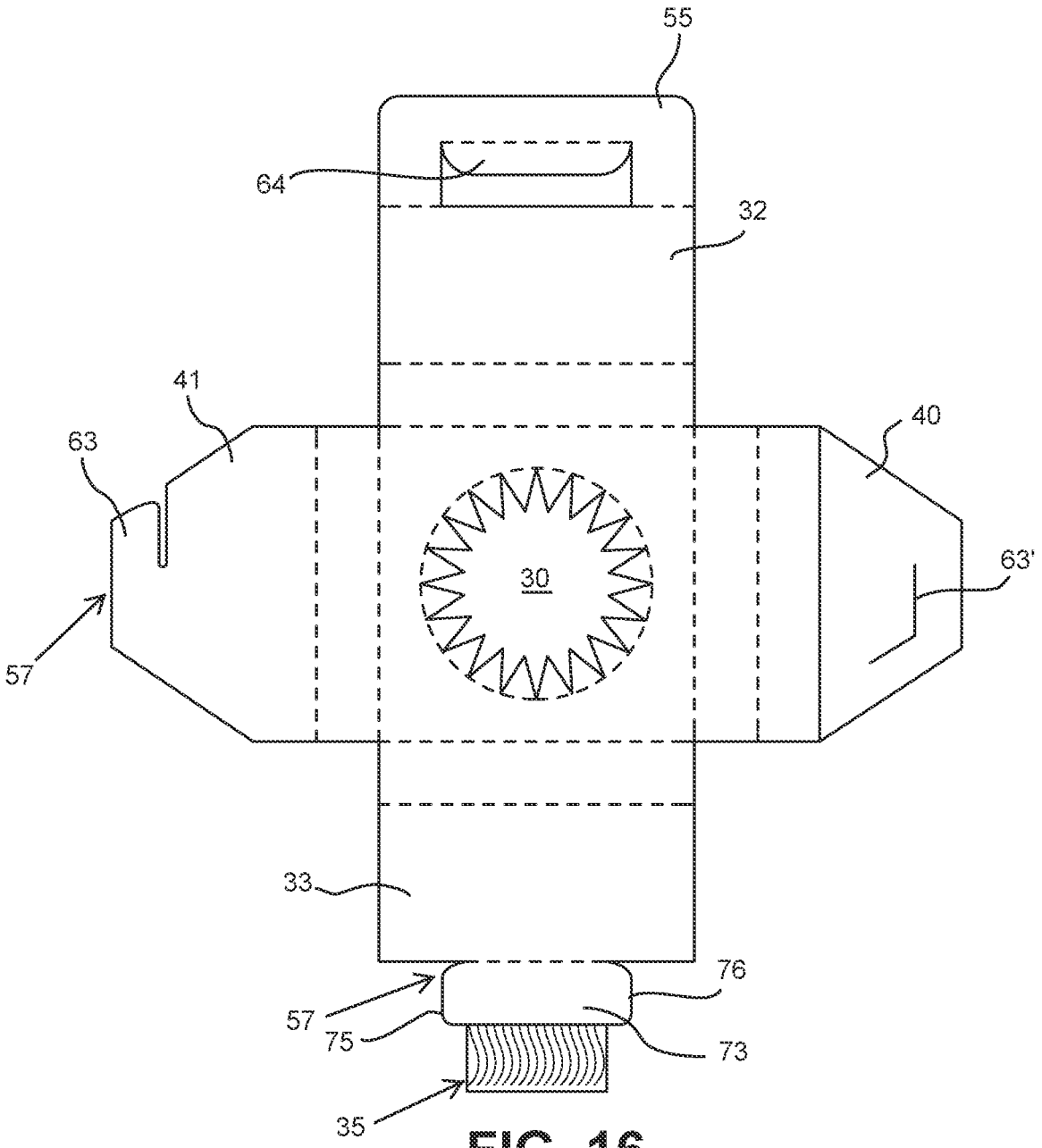
FIG. 16 is a top plan view of yet another alternative embodiment enclosure assembly.
Figure 17:
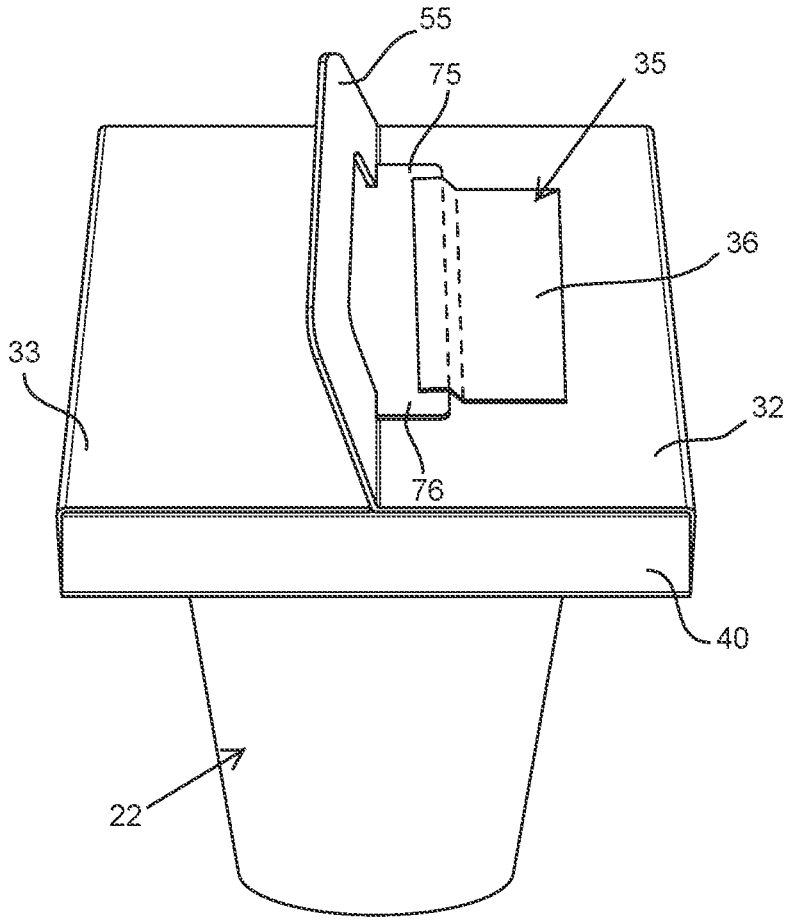
FIG. 17 is a top perspective view of the enclosure assembly of FIG. 16 mounted to the container.

Turning now to another alternative embodiment, FIGS. 16 and 17 illustrate a single handle portion 55 distally mounted to one wing extension 32 while the other wing extension 33 includes the tongue latch 73. This latch includes an additional tab portion component in the form of opposed winglets 75, 76 that fan outwardly when positioned through the opposed handle 55 of the wing extension 32 (FIG. 17). As shown and mentioned, the winglets 75, 76 are capable of fanning outward and cooperate with the legs of the handle portion 55 for removably latching thereto, in the engaged position.

Figure 19:
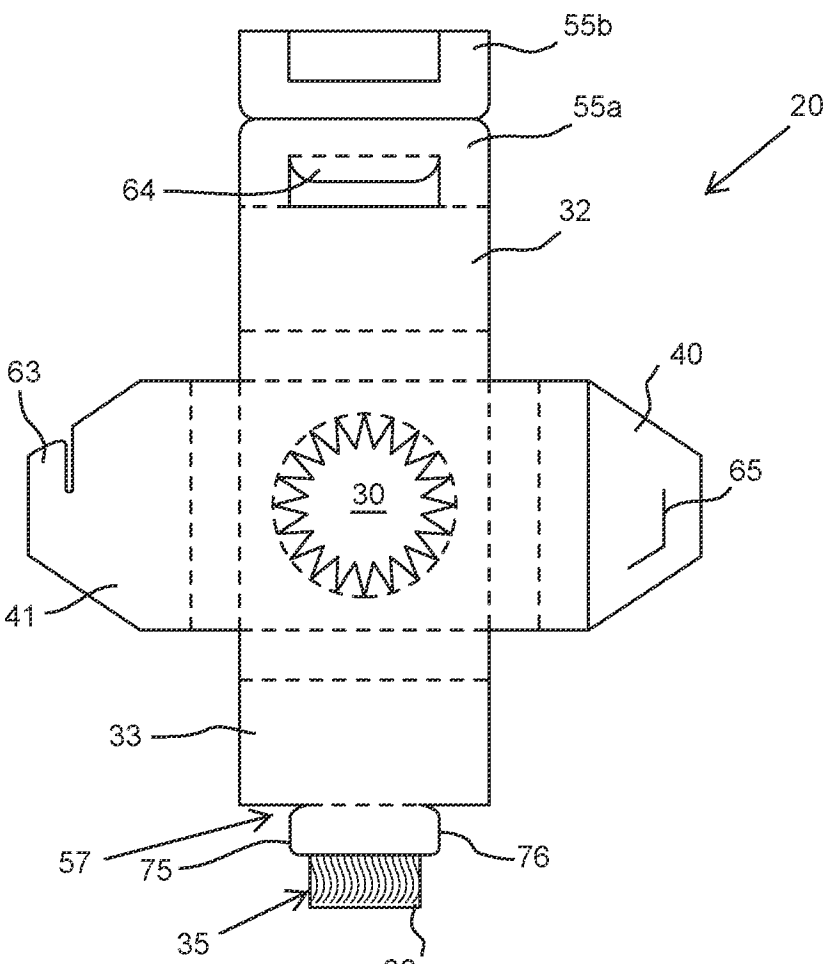
FIG. 19 is a top plan view of another alternative embodiment enclosure assembly.
Figure 18:
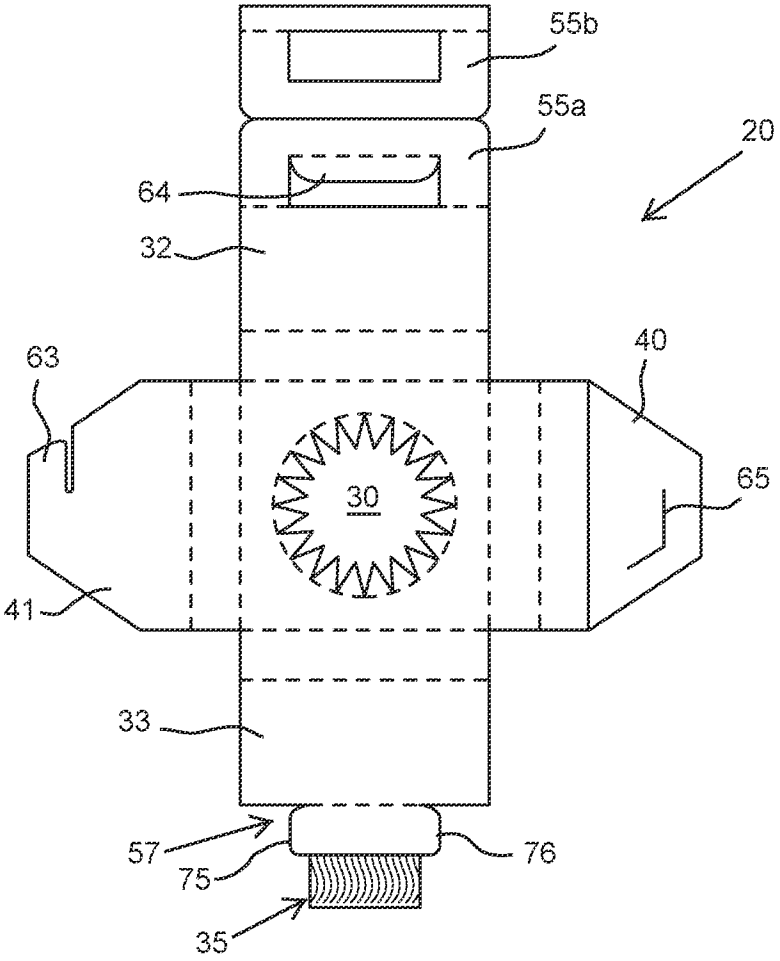
FIG. 18 is a top plan view of still another alternative embodiment enclosure assembly.

FIGS. 18 and 19 illustrate yet another alternative configuration similar to that of the previous embodiment of FIGS. 16 and 17, except the one of the wing extensions (e.g., extension 32 includes a foldable, doubled up handle portions 55*a*, 55*b* to increase its structural integrity. The foldable handle tab 64 maintains the folded handle portions 55*a*, 55*b* in their doubled configuration.

Figure 20:
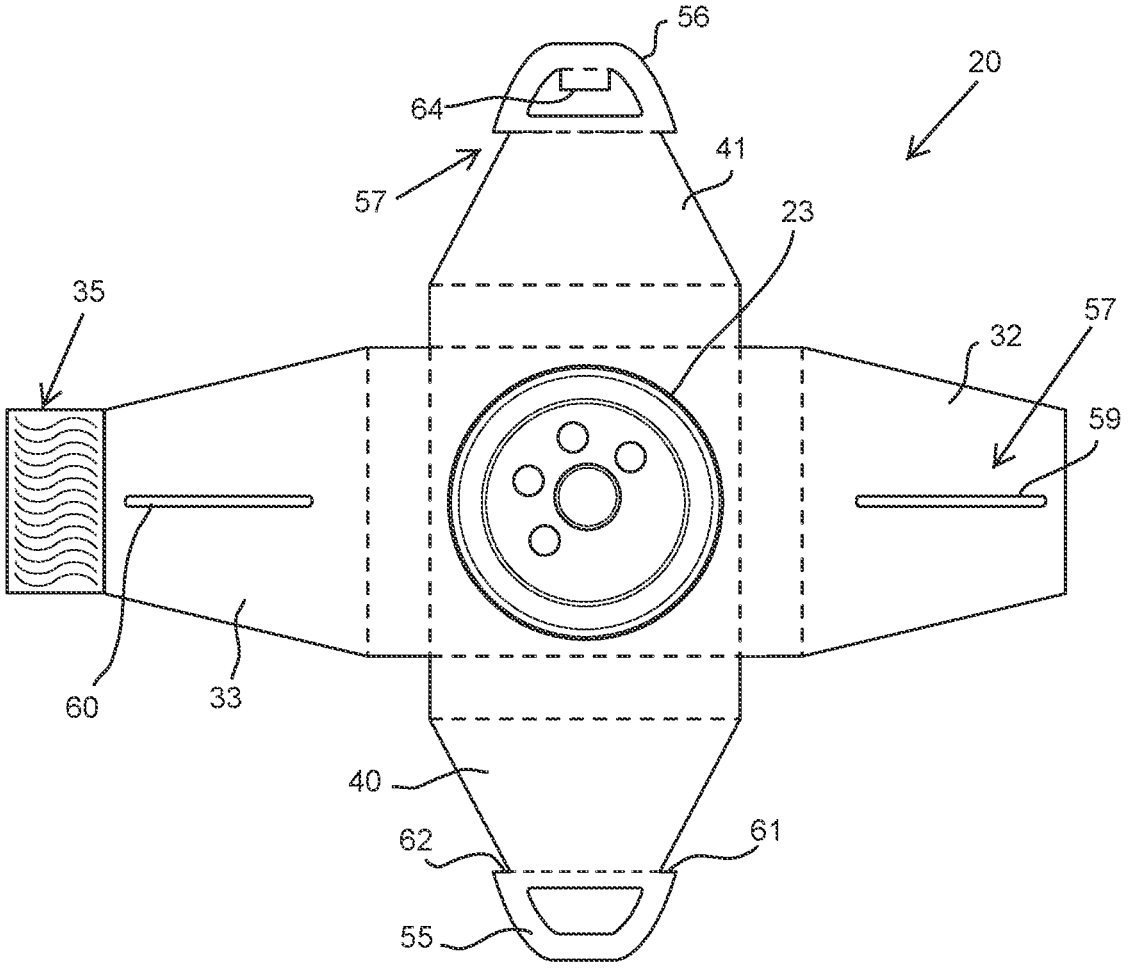
FIG. 20 is a top plan view of yet another alternative embodiment enclosure assembly with a container in the seated condition.
Figure 21:
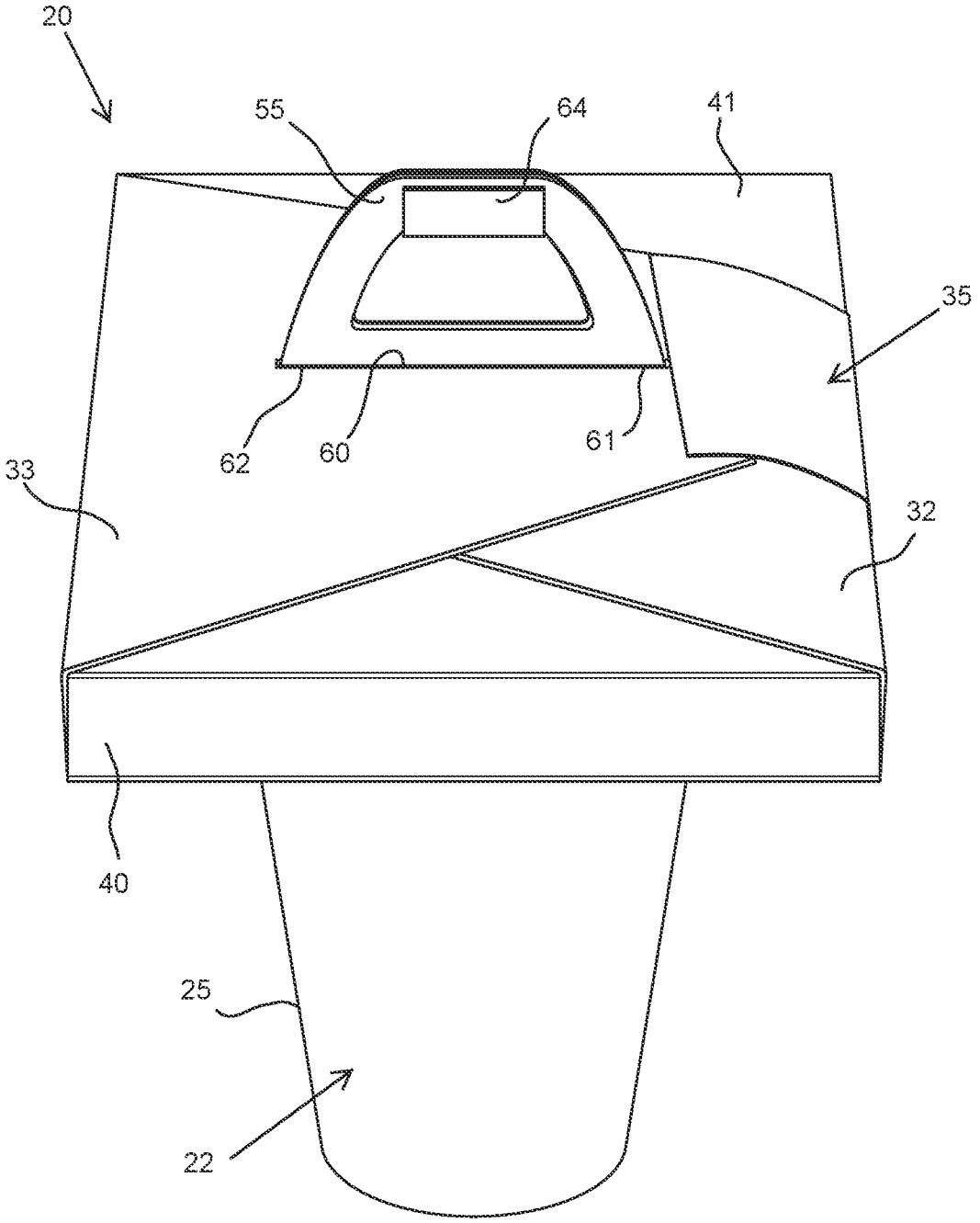
FIG. 21 is a top perspective view of the enclosure device of FIG. 20 mounted to a container.

The embodiment of FIGS. 20 and 21 is substantially similar to the embodiment of FIGS. 2-8. However, the handle portion 55 of one wing protrusion 41 includes a handle tab 64 configured to couple the handle portions 55, 56 together.

Figure 22:
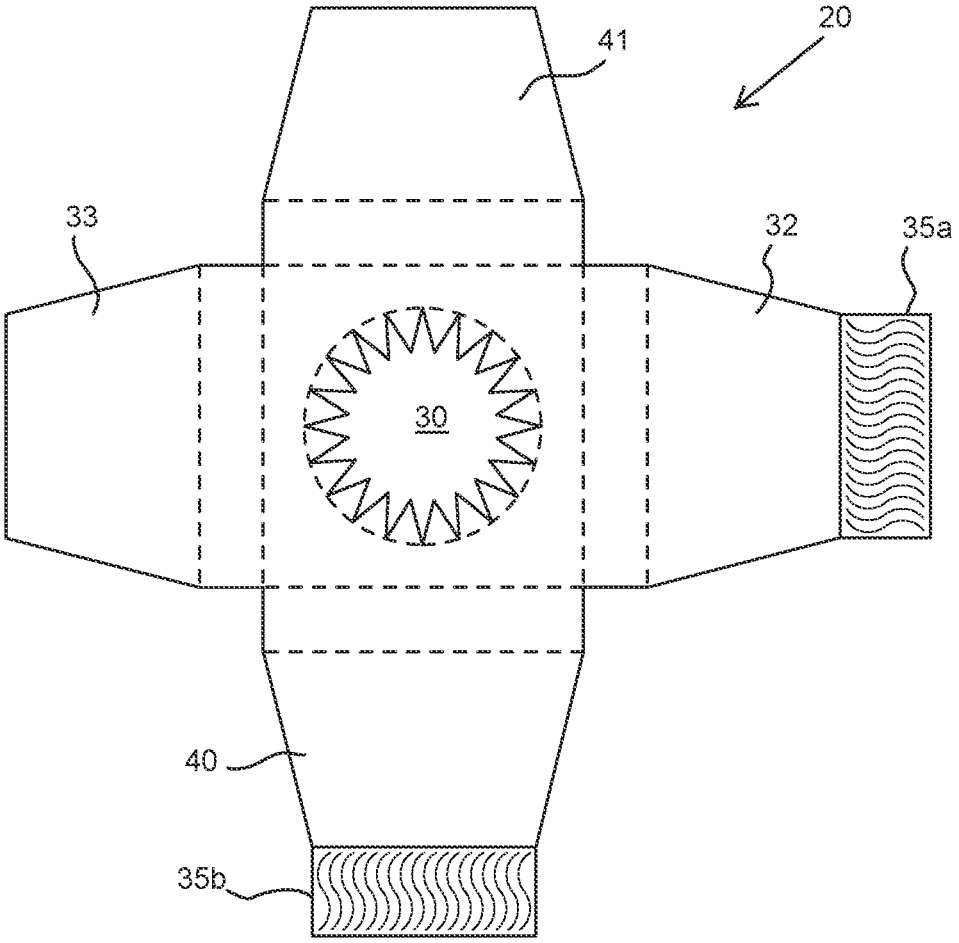
FIG. 22 is a top plan view of still another alternative embodiment enclosure assembly.

FIG. 22 illustrates another alternative embodiment enclosure assembly 20 that does not include any handles, or any tab portions. However, this configuration includes two independent closure tapes 35*a*, 35*b*. In this arrangement, one wing protrusion 40 and one wing extension 32 support the closure tapes thereon, prior to adherence in the sealed condition.

Figure 23:
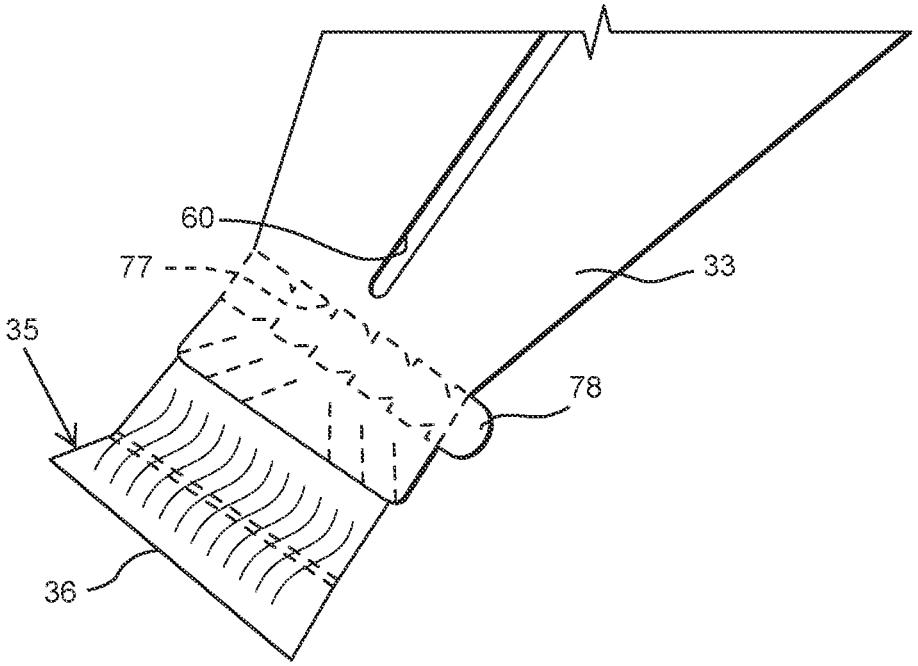
FIG. 23 is a fragmentary bottom perspective view of an alternative embodiment wing extension with an integral pull tab.
Figure 24:
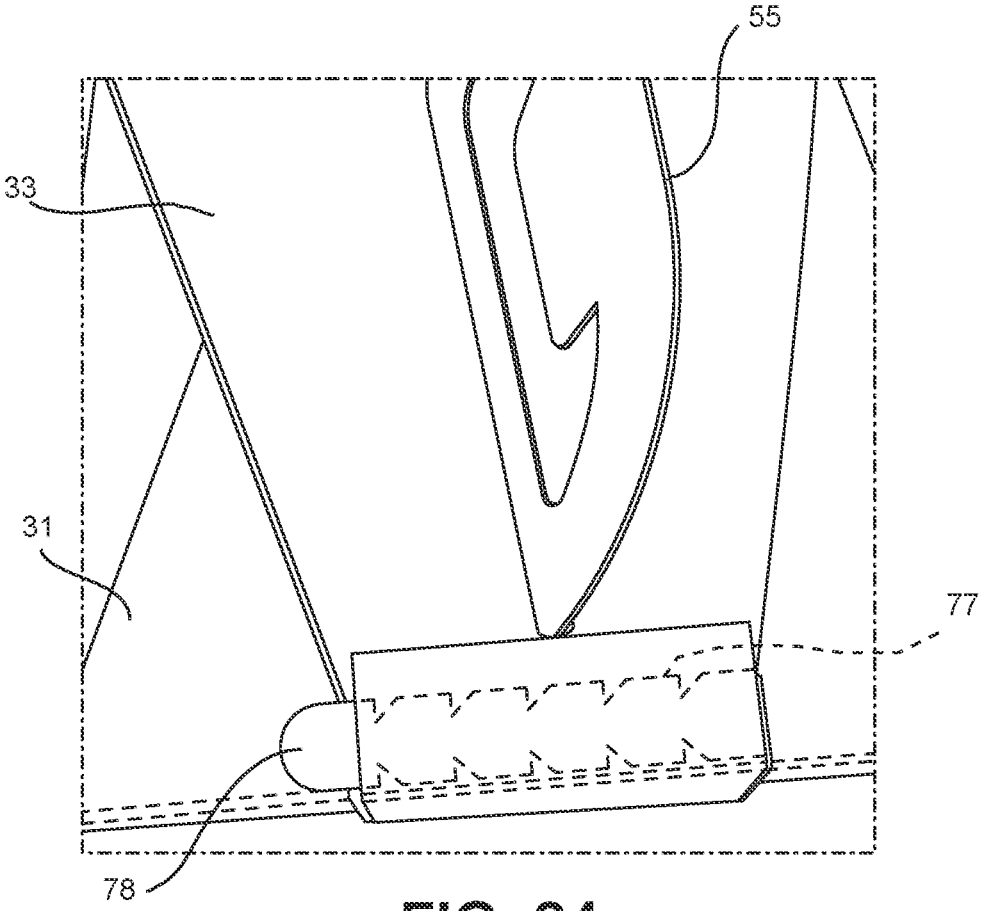
FIG. 24 is a fragmentary top perspective view of the wing extension of FIG. 23 in and engaged and sealed condition with the remaining enclosure assembly.

The embodiment of FIGS. 23 and 24 illustrate an enclosure assembly 20 wherein one of the wing extensions 33 includes a pull tab perforation 77 that extends transverse to the secured closure tape 35. As shown on the underside of the wing extension 33 (FIG. 22), this provides a simple manner to open the sealed enclosure assembly. Once the closure tape 35 seals the wing extensions 32, 33, in the sealed and engaged condition, a tab portion 78 of the pull tab perforation 77 can be manually pulled to sever the closure tape 35, enabling access to the contents of the container 22.

Figure 25:
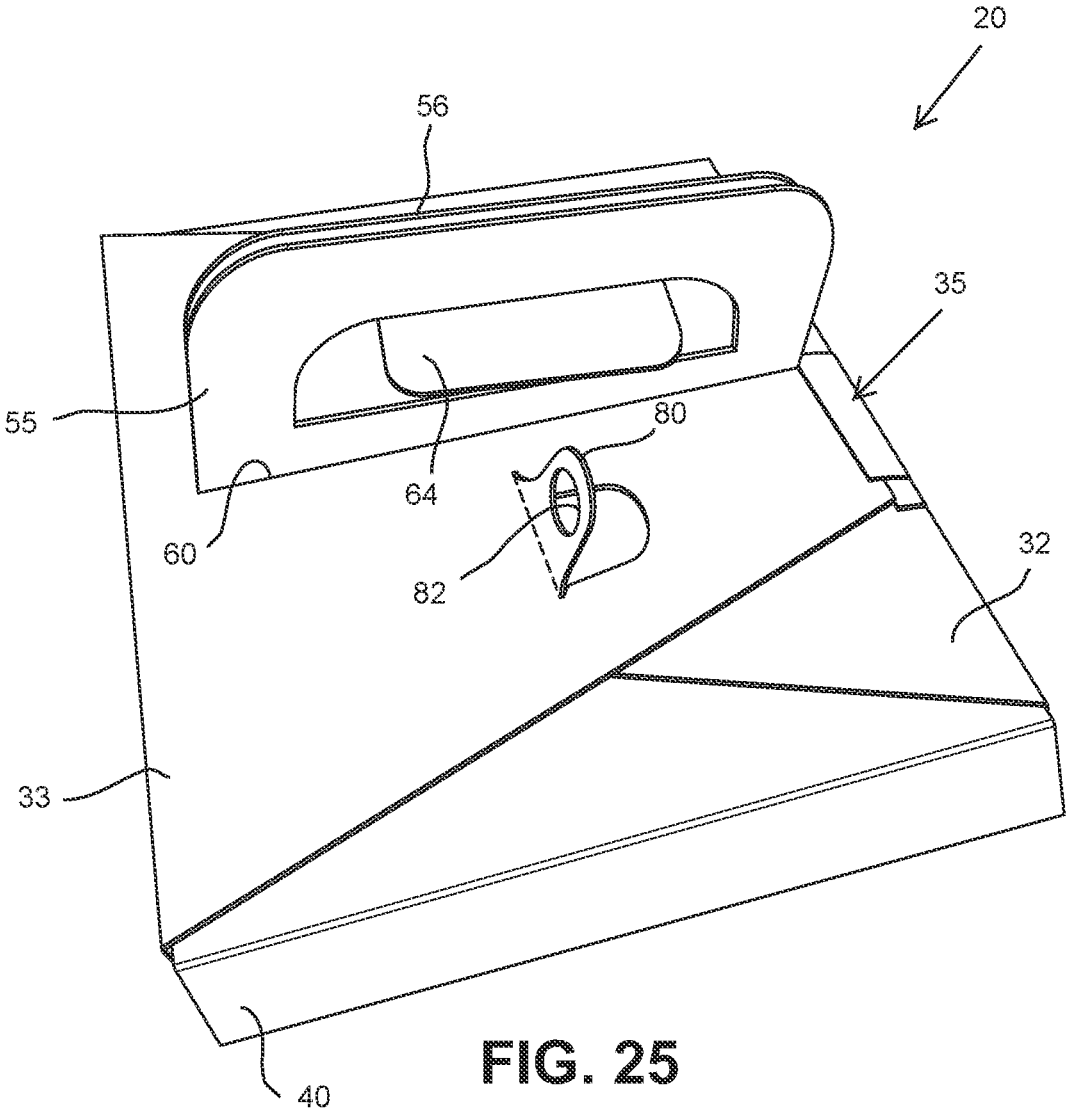
FIG. 25 is a top perspective view of another alternative embodiment enclosure assembly with an integrated straw cradle.
Figure 26:
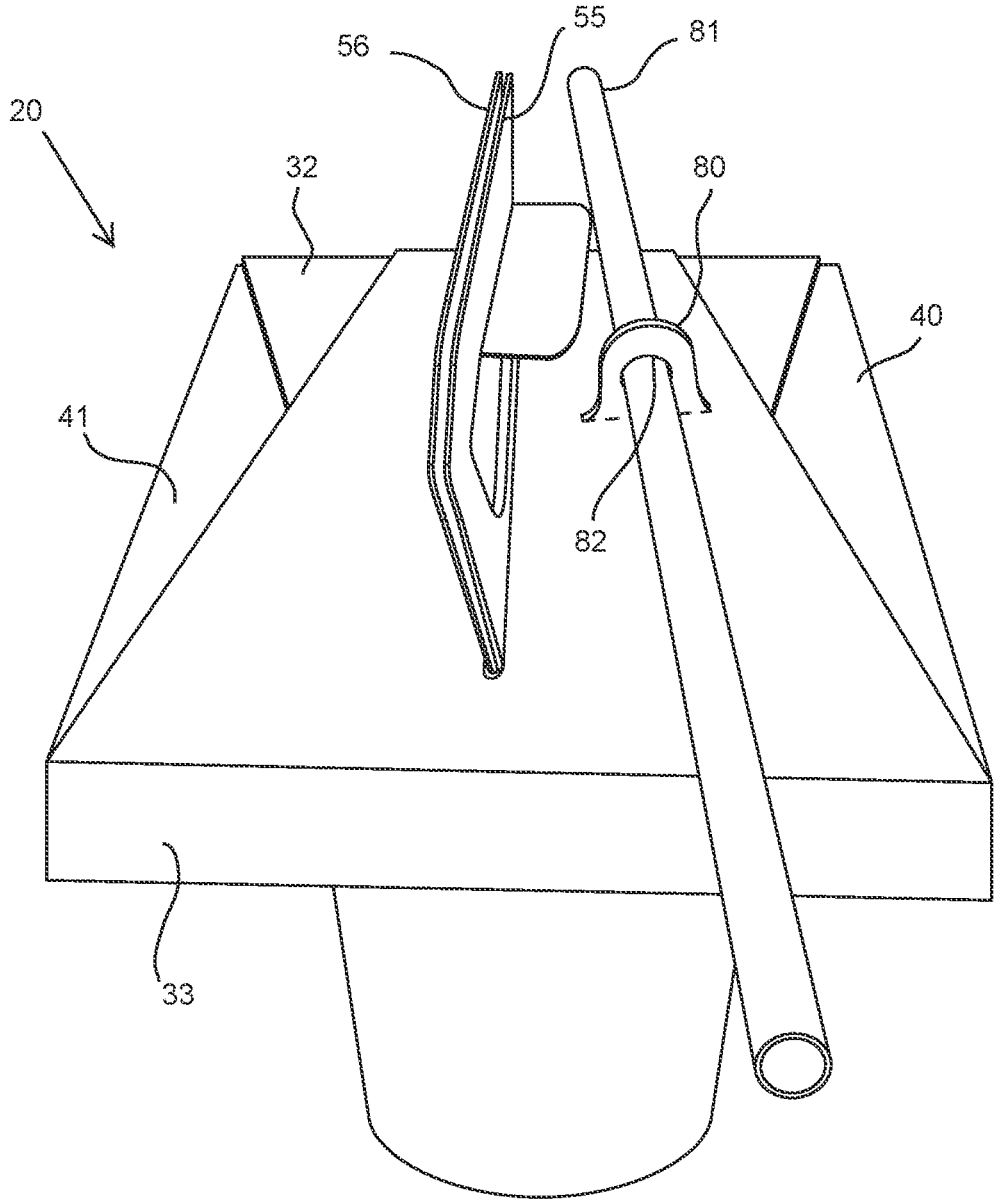
FIG. 26 is a top perspective view enclosure assembly of FIG. 25 with a straw removably retained in the straw cradle.

Referring now to FIGS. 25 and 26, this alternative embodiment includes the incorporation of an integral pop-up straw holder 80 in one wing extension 33. Once the enclosure assembly 20 is placed in the sealed condition, as shown in FIG. 24, a straw 81 can be positioned through a hole 82 of the straw holder 80 for support thereof (FIG. 26). It will be appreciated that one or more pop-up straw holders 80 could be integral with any of the wing protrusions 40, 41 and the wing extensions 32, 33.

Figure 27:
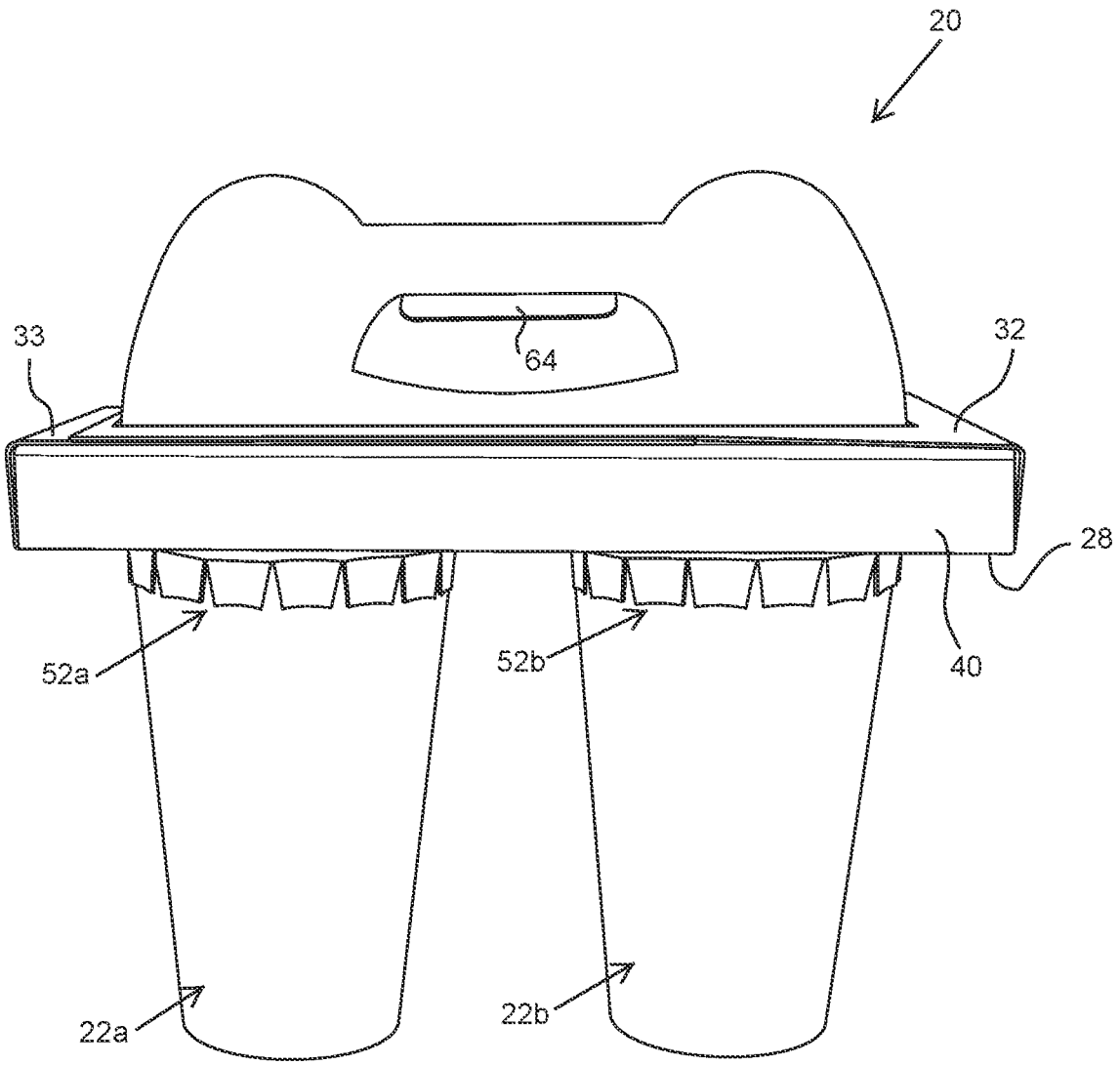
FIG. 27 is a side perspective view of another alternative embodiment enclosure assembly configured to accommodate two containers.

It will be further appreciated that the enclosure assembly design of the present invention can be applied to carry and secure multiple containers 22*a* and 22*b*. As best shown in FIG. 27 for instance, a handled, two-container enclosure assembly 20 is provided wherein the base portion 28 defines two seating apertures which include tension sleeves 52*a* and 52*b*. In this configuration, the wing extensions 32, 33 are significantly elongated and/lengthened to accommodate the rectangular base portion 28 necessary to define two seating apertures.

While the present invention has been described in connection with the preferred form of practicing it and modifications thereto, those of ordinary skill in the art will understand that many other modifications can be made thereto within the scope of the claims that follow. Accordingly, it is not intended that the scope of the invention in any way be limited by the above description, but instead be determined entirely by reference to the claims that follow.

What is claimed is:

1. A tamper evident enclosure assembly for a food/beverage container having a content receiving region, and a vertically elongated, circumferential sidewall that tapers radially outward from a lower portion to an upper portion thereof, said circumferential sidewall terminating at an upper circumferential lip portion that defines a mouth portion into the content receiving region, the container including a lid that is configured to press-fit mount over the mouth portion of the container, said enclosure assembly comprising:

a thin base portion defined by a base perimetric edge, and having a seating aperture configured for substantially unobstructed receipt of the lower portion of said container therethrough until an interior portion defining the seating aperture substantially, perimetrically contacts and supportably seats generally against the upper portion of the circumferential sidewall proximate to the lip portion of the container, at a seated position, such that the lip portion of the container does not pass through said seating aperture while the lower portion of said container is situated below said base portion;

a pair of foldable wing extensions coupled to generally opposed sections of the base perimetric edge, and configured to foldably extend upwardly from said base portion, when in the seated position, in a manner such that said foldable wing extensions substantially extend laterally over the container mouth portion and mounted lid to form an interior pocket, in an engaged condition, that substantially prevents access to the mounted lid;

a thin, generally rigid, adapter insert having an insert perimetric edge configured to fit within the footprint of the base perimetric edge of said base portion and adapted for unadherred placement within the enclosure assembly interior pocket, in the engaged condition, said adapter insert defining an insert aperture having a perimetric footprint that is smaller than that of said seating aperture;

a single use closure tape laterally mounted to one of the wing extensions, and having an upper lateral portion extending beyond the wing member in an unsealed condition, said closure tape further including an adhesive disposed on an interior surface of the tape upper lateral portion; and a removable protective strip that removably covers the adhesive;

wherein, when the protective strip is removed, and said wing extensions are in the engaged condition, said tape upper lateral portion can be folded over such that said adhesive is brought into contact with an exterior surface of said enclosure assembly, substantially locking said wing extensions in a sealed condition.

2. The tamper evident enclosure assembly as recited in claim 1, wherein said wing extensions each include a first pre-fold at a location where said wing extensions are coupled to said base portion, and a second pre-fold, generally parallel to and spaced apart from said first pre-fold a first fold distance that is at least the length as a seated distance, generally between the base portion and the container lip portion when the enclosure assembly is in the seated position.

3. The tamper evident enclosure assembly as recited in claim 2, wherein said seated distance is generally in the range of about 0.5 in. to about 1.5 in. vertically from the lip portion of the container.

4. The tamper evident enclosure assembly as recited in claim 2, further including:

a pair of foldable wing protrusions coupled to generally opposed portions of the base perimetric edge, and oriented generally transverse to said pair foldable wing extensions, each foldable wing protrusion being configured to foldably extend upwardly from said base portion, when in the seated position, in a manner such that said pair of foldable wing extensions substantially extend over the container mouth portion and the mounted lid, in a coupled condition, said pair of foldable wing extensions, in the engaged condition, and the pair foldable wing protrusions, in the coupled condition, forming said interior pocket that substantially encapsulate the container mouth portion and the mounted lid therein.

5. The tamper evident enclosure assembly as recited in claim 4, wherein said wing extensions and said wing protrusions each including a first pre-fold at a location where the associated wing extensions and the associated wing protrusions are coupled to said base portion, and a second pre-fold, generally parallel to and spaced apart from the respective first pre-fold a second fold distance that is at least the length of the first fold distance.

6. The tamper evident enclosure assembly as recited in claim 5, wherein said base perimetric edge is generally rectangular in shape.

7. The tamper evident enclosure assembly as recited in claim 5, wherein at least one of the wing extension and the wing protrusion includes a tab portion configured to removably retain the wing extensions in the engaged condition, and the wing protrusions in the coupled condition prior to movement of the closure tape to the sealed condition.

8. The tamper evident enclosure assembly as recited in claim 4, wherein at least one of the wing extensions and the wing protrusions includes a handle portion.

9. The tamper evident enclosure assembly as recited in claim 2 wherein said base portion includes a plurality of foldable seating teeth extending radially inward from a seating edge that defines said seating aperture.

10. The tamper evident enclosure assembly as recited in claim 1 wherein said closure tape includes a tear feature configured to facilitate tearing of said closure tape to open the enclosure device, when in the sealed condition, to thereby provide access to the content receiving region thereof.

11. The tamper evident enclosure assembly as recited in claim 1, wherein said seating aperture is generally circular shaped.

12. A tamper evident enclosure assembly for a food/beverage container having a content receiving region, and a circumferential sidewall that tapers radially outward from a lower portion to an upper portion thereof, said circumferential sidewall terminating at an upper circumferential lip portion that defines a mouth portion into the content receiving region, the container including a lid that is configured to press-fit mount over the mouth portion of the container, said enclosure assembly comprising:

a thin base portion defined by a generally rectangular base perimetric edge, and having a seating aperture configured for substantially unobstructed receipt of the lower portion of said container therethrough until an interior portion defining the seating aperture substantially, perimetrically contacts and supportably seat generally against the upper portion of the circumferential sidewall proximate to the lip portion of the container, at a seated position, such that the lip portion of the container does not pass through said seating aperture while the lower portion of said container is situated below said base portion;

a pair of foldable wing extensions coupled to generally opposed sections of the base perimetric edge;

a pair of foldable wing protrusions coupled to generally opposed portions of the base perimetric edge, oriented generally perpendicular to said pair foldable wing extensions, wherein each foldable wing extension and each foldable wing protrusion is being configured to foldably extend upwardly from said base portion, when in the base portion is in the seated position, in a manner such that said foldable wing extensions and said wing protrusion each substantially laterally extend over the container mouth portion and mounted lid to collectively substantially encapsulate the same therein in an interior pocket formed thereby, in an engaged condition and a coupled condition, respectively, that substantially prevents access to the mounted lid;

a thin, generally rigid, adapter insert having an insert perimetric edge configured to fit within the footprint of the base perimetric edge of said base portion and adapted for unadherred placement within the enclosure assembly interior pocket, in the engaged condition, said adapter insert defining an insert aperture having a perimetric footprint that is smaller than that of said seating aperture;

a single use closure tape laterally mounted to at least one of the wing extension and the wing protrusion, and having an upper lateral portion extending beyond the respective wing extension and/or wing protrusion, in an unsealed condition, said closure tape further including an adhesive disposed on an interior surface of the tape upper lateral portion; and a removable protective strip that removably covers the adhesive;

wherein, when the protective strip is removed, and said wing extensions are in the engaged condition and said wing protrusions are in the coupled condition, said tape upper lateral portion can be folded over such that said adhesive is brought into contact with an exterior surface of said enclosure assembly, substantially locking said wing extensions and said wing protrusions in a sealed condition.

13. The tamper evident enclosure assembly as recited in claim 12 wherein at least one of the wing extension and the wing protrusion includes a tab portion configured to removably retain the wing extensions in the engaged condition, and the wing protrusions in the coupled condition prior to movement of the closure tape to the sealed condition.

14. The tamper evident enclosure assembly as recited in claim 13, wherein said wing extensions and said wing protrusions each include a first pre-fold generally at said opposed sections and said opposed portions, respectively, of said base perimetric edge where said wing extensions and said wing protrusions are coupled to said base portion, and each include a second pre-fold, generally parallel to and spaced apart from the respective first pre-fold a fold distance that is at least the length as a seated distance, generally between the base portion and the container lip portion when the enclosure assembly is in the seated position.

15. The tamper evident enclosure assembly as recited in claim 14, wherein said seated distance is generally in the range of about 0.5 in. to about 1.5 in. vertically from the lip portion of the container.

16. The tamper evident enclosure assembly as recited in claim 13, wherein at least one of wing extensions and the wing protrusions includes a handle portion.

17. The tamper evident enclosure assembly as recited in claim 12 wherein said base portion includes a plurality of foldable seating teeth extending radially inward from a seating edge which defines said seating aperture, and said adapter insert includes a plurality of foldable seating tabs extending radially inward from an interior insert edge which defines said insert aperture.

18. The tamper evident enclosure assembly as recited in claim 12 wherein said closure tape includes a tear feature configured to facilitate tearing of said closure tape to open the enclosure device, when in the sealed condition, to thereby provide access to the content receiving region thereof.

19. A tamper evident method for delivering a food beverage/container having a content receiving region, and a vertically elongated, circumferential sidewall that tapers radially outward from a lower portion to an upper portion thereof, said circumferential sidewall terminating at an upper circumferential lip portion that defines a mouth portion into the content receiving region, the container including a lid that is configured to press-fit mount over the mouth portion of the container, said method comprising:

providing an enclosure assembly having a thin base portion defined by a generally rectangular base perimetric edge, and defining a seating aperture configured to for substantially unobstructed receipt of the lower portion of said container therethrough to supportably seat generally against the upper portion of the circumferential sidewall proximate to the lip portion of the container, at a seated position, such that the lip portion of the container does not pass through said seating aperture, said enclosure assembly further including a pair of foldable wing extensions coupled to generally opposed sections of the base perimetric edge, and a pair of foldable wing protrusions coupled to generally opposed portions of the base perimetric edge, oriented generally perpendicular to said pair foldable wing extensions, a thin, generally rigid, adapter insert having an insert perimetric edge configured to fit within the footprint of the base perimetric edge of said base portion and adapted for unadherred placement within the enclosure assembly interior pocket, in the engaged condition, said adapter insert defining an insert aperture having a perimetric footprint that is smaller than that of said seating aperture, and a single use closure tape laterally mounted to at least one of the wing extension and the wing protrusion, and having an upper lateral portion extending beyond the respective wing extension and/or wing protrusion, in an unsealed condition, said closure tape further including an adhesive disposed on an interior surface of the tape upper lateral portion that is covered by a removable protective strip;

placing the lower portion of the food/beverage container into and through the insert aperture of the adapter insert until said insert perimetric edge defining the insert aperture substantially, perimetrically contacts and supportably seats generally against the upper portion of the container wherein the lower portion of said container is situated below said base portion;

placing the lower portion of the food/beverage container into and through the seating aperture of the base portion until said adapter insert seats atop said base portion;

folding each wing protrusion upwardly from said base portion over the mounted cup lid, and inwardly toward one another in a manner such that said foldable wing protrusion each substantially extend laterally over the container mouth portion and mounted lid in a coupled condition;

folding each wing extension upwardly from said base portion over the mounted cup lid, and inwardly toward one another in a manner such that said foldable wing extension each substantially extend laterally over the container mouth portion and mounted lid in an engaged condition, said wing protrusions in the coupled condition and said wing extensions in the engaged condition collectively to substantially encapsulate the container mouth portion and mounted lid therein in an interior pocket formed thereby that substantially prevents tampering access to the mounted lid;

removing the protective strip from the upper lateral portion of the closure tape, exposing the adhesive, in the unseal condition; and contacting the exposed adhesive with an exterior surface of said enclosure assembly, substantially locking said wing extensions and said wing protrusions in a sealed condition.

20. The tamper evident method according to claim 19, wherein at least one of the wing extension and the wing protrusion includes a tab portion configured to removably retain the wing extensions in the engaged condition, and the wing protrusions in the coupled condition, said method further including at least one of coupling the wing protrusion together in the coupled condition and engaging said wing extension together in the engaged condition prior to contacting the exposed adhesive to the sealed condition.

* * * * *